US012780475B2

(12) United States Patent
Cousins et al.

(10) Patent No.: US 12,780,475 B2
(45) Date of Patent: Nov. 3, 2026

(54) PORTABLE WRAPPING MACHINE WITH GATE

(71) Applicant: COUSINS PACKAGING INC., Mississauga (CA)

(72) Inventors: Neil G. Cousins, Tottenham (CA); Srbislav Z. Davidovic, Oakville (CA)

(73) Assignee: COUSINS PACKAGING INC., Mississauga (CA)

( * ) Notice: Subject to any disclaimer, the term of this patent is extended or adjusted under 35 U.S.C. 154(b) by 0 days.

(21) Appl. No.: 19/249,332

(22) Filed: Jun. 25, 2025

(65) Prior Publication Data

US 2026/0001672 A1 Jan. 1, 2026

Related U.S. Application Data

(60) Provisional application No. 63/665,002, filed on Jun. 27, 2024.

(51) Int. Cl.
*B65B 57/00* (2006.01)
*B65B 11/02* (2006.01)

(52) U.S. Cl.
CPC ..... *B65B 57/005* (2013.01); *B65B 11/025* (2013.01); *B65B 2210/20* (2013.01)

(58) Field of Classification Search
CPC . B65B 57/005; B65B 11/025; B65B 2210/20; B65B 11/045; B65B 11/585; B65B 2011/002; B65B 2210/18; B65B 11/00; B65B 2210/16; B65B 11/58; B65B 2210/14; B65B 11/008; B65B 11/02; B65B 11/04; B65B 11/06
See application file for complete search history.

(56) References Cited

U.S. PATENT DOCUMENTS

| | | | | |
|---|---|---|---|---|
| 11,643,230 | B2 | 5/2023 | Cousins et al. | |
| 2013/0227919 | A1 | 9/2013 | Cousins | |
| 2018/0162660 | A1 * | 6/2018 | Saylor | B65G 57/03 |
| 2022/0169468 | A1 | 6/2022 | Cousins et al. | |

* cited by examiner

*Primary Examiner* — Veronica Martin
(74) *Attorney, Agent, or Firm* — FLYNN THIEL, P.C.

(57) ABSTRACT

A portable wrapping machine comprising a movable frame for moving along a track of a facility, with the frame defining an interior space. A wrapping arm assembly is connected to the movable frame for encircling a full pallet located within the interior space to wrap the full pallet with wrap film. A fence system is connected to the movable frame for surrounding the interior space from before initiation of a wrapping process until the wrapping process is complete, the fence system including a pair of fixed side fences and a pair of movable gates. Each of the movable gates being raised during movement of the portable wrapping machine. Each of the movable gates also is lowered to thereby surround the interior space of the portable wrapping machine with the fence system while the wrapping arm assembly encircles the full pallet to wrap the full pallet in wrap film.

19 Claims, 22 Drawing Sheets

PORTABLE WRAPPING MACHINE WITH GATE

CROSS-REFERENCE TO RELATED APPLICATION

This claims the benefit of U.S. Provisional Application No. 63/665,002, filed Jun. 27, 2024, the disclosure of which is hereby incorporated by reference in its entirety.

FIELD OF THE INVENTION

The present invention concerns wrapping machines, and more particularly relates to a portable wrapping machine with a gate.

BACKGROUND OF THE INVENTION

During the past several decades, considerable developments have been made in the field of wrapping a load with a web of film. There is a desire to automate such a process as much as possible along with maintaining safety standards.

SUMMARY OF THE INVENTION

An aspect of the present invention is to provide a pallet wrapping facility comprising a wrapping lane having a plurality of pallet position areas, with each of the pallet position areas being configured to have a pallet positioned therein, a portable wrapping machine that moves along the wrapping lane and being configured to stop at each of the pallet position areas to wrap a pallet full of goods in a particular one of the pallet position areas, and a track along the wrapping lane. The portable wrapping machine is configured to move along the track to the pallet position areas. The portable wrapping machine includes a frame for moving along the track to the particular one of the pallet position areas with the full pallet therein. The portable wrapping machine includes a wrapping arm assembly for encircling the full pallet to wrap the full pallet with wrap film during a wrapping process. The portable wrapping machine includes a fence system for surrounding an interior space of the portable wrapping machine from before initiation of the wrapping process until the wrapping process is complete. The fence system includes a pair of fixed side fences and a pair of movable gates. Each of the movable gates is configured to be moved to a movement position during movement of the portable wrapping machine along the track to and from the different pallet position areas to allow the portable wrapping machine to move to the different pallet position areas. Each of the movable gates also is configured, once the portable wrapping machine is in the particular one of the pallet position areas, to be moved from the movement position to a deployed position to thereby surround the interior space of the portable wrapping machine with the fence system while the wrapping arm assembly encircles the full pallet to wrap the full pallet in wrap film.

Another aspect of the present invention is to provide a portable wrapping machine comprising a movable frame for moving along a track of a facility, with the movable frame defining an interior space. A wrapping arm assembly is connected to the movable frame for encircling a full pallet located within the interior space to wrap the full pallet with wrap film. A fence system is connected to the movable frame for surrounding the interior space from before initiation of a wrapping process until the wrapping process is complete, the fence system including a pair of fixed side fences and a pair of movable gates. Each of the movable gates being raised during movement of the portable wrapping machine. Each of the movable gates also is lowered to thereby surround the interior space of the portable wrapping machine with the fence system while the wrapping arm assembly encircles the full pallet to wrap the full pallet in wrap film.

DETAILED DESCRIPTION OF THE PREFERRED EMBODIMENT

Figure 1:
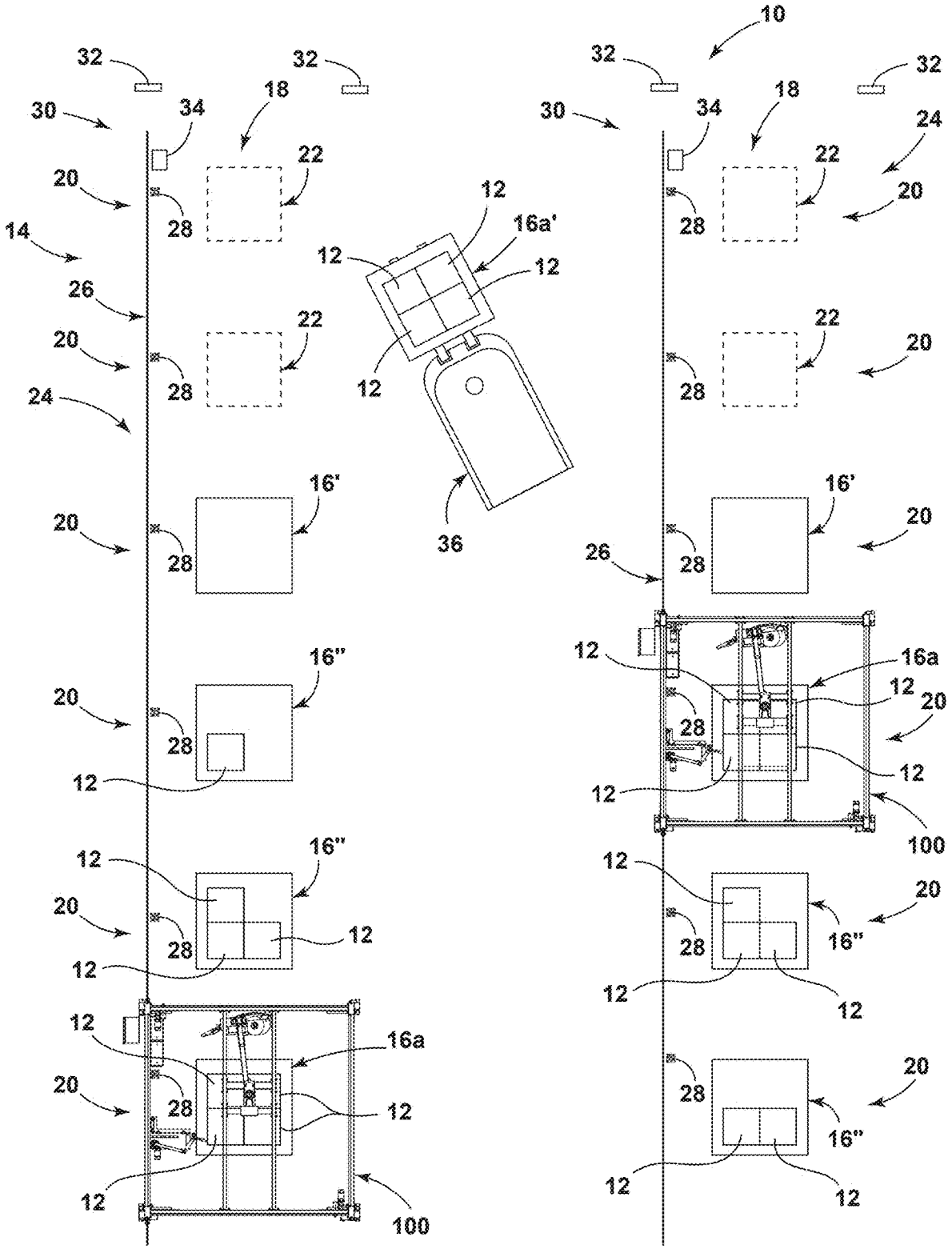
FIG. 1 is a schematic top view of a packaging and shipping facility of the present invention.
Figure 2:
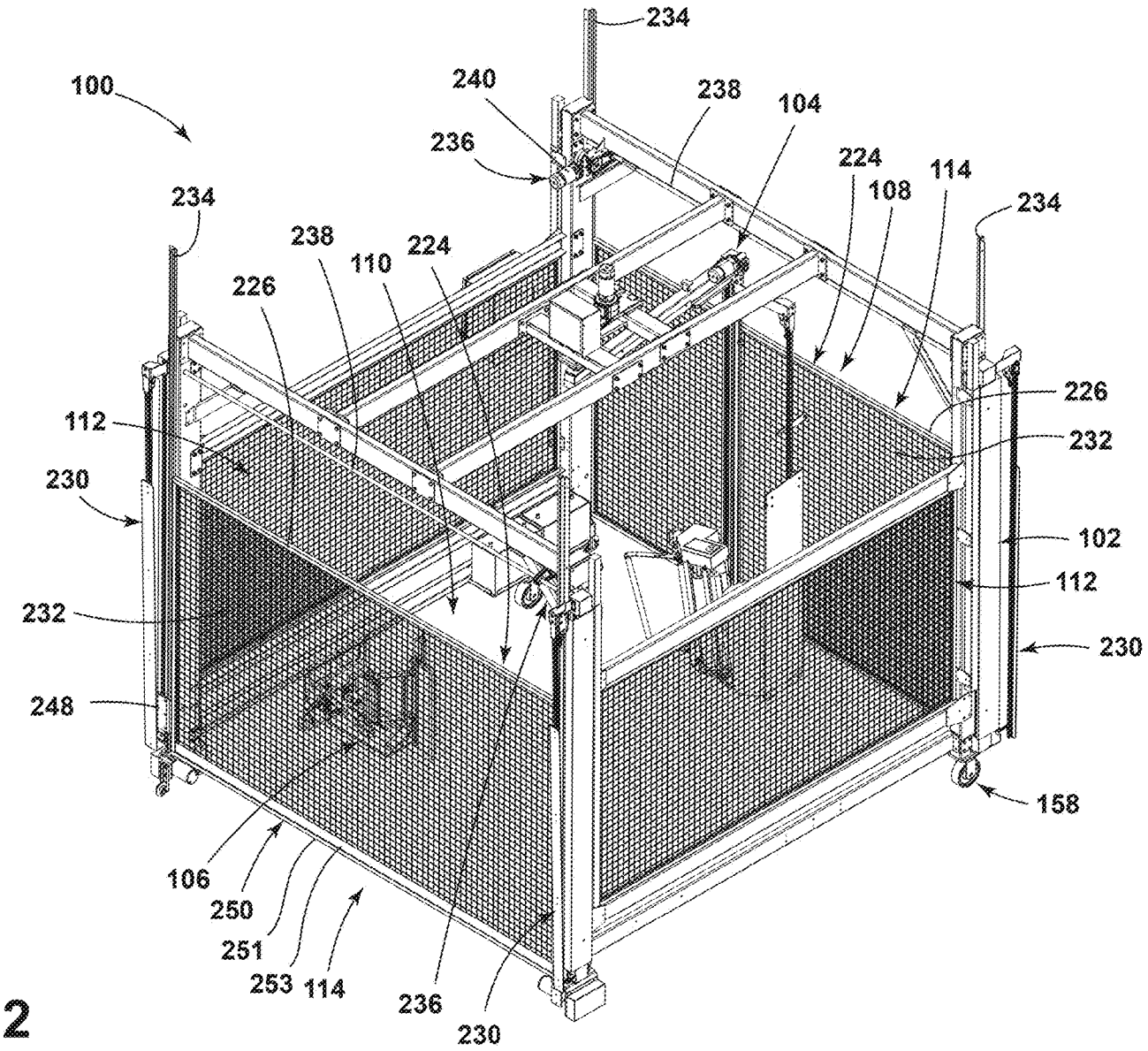
FIG. 2 is a top front perspective view of a portable wrapping machine of the present invention.

For purposes of description herein, the terms "upper," "lower," "right," "left," "rear," "front," "vertical," "horizontal," and derivatives thereof shall relate to the invention as orientated in FIG. 1. However, it is to be understood that the invention may assume various alternative orientations, except where expressly specified to the contrary. It is also to be understood that the specific devices and processes illustrated in the attached drawings, and described in the following specification are simply exemplary embodiments of the inventive concepts. Hence, specific dimensions and other physical characteristics relating to the embodiments disclosed herein are not to be considered as limiting.

The reference number 10 (FIG. 1) generally designates a schematic top view of a packaging and shipping facility. The packaging and shipping facility 10 houses goods (e.g., on shelves) for shipping to individuals or organizations. The goods in the packaging and shipping facility 10 can be in a box 12 or placed in a box 12, with either an individual good placed in a box 12, a plurality of the same goods placed in a box 12, or a plurality of different goods placed in a box 12. FIG. 1 illustrates a shipping area 14 of the packaging and shipping facility 10. In the shipping area 14 of the packaging and shipping facility 10, a plurality of boxes 12 are positioned on various pallets 16', 16", **16*a*, 16*a*'. A full pallet 16*a*, that is a pallet completely loaded with boxes 12 and ready to be wrapped, is wrapped by a portable wrapping machine 100** before being shipped.

The illustrated shipping area 14 of the packaging and shipping facility 10 can include at least one wrapping lane 18. While two (2) wrapping lanes 18 are shown in FIG. 1, any number of wrapping lanes 18 can be used (including a single wrapping lane 18). Each wrapping lane 18 includes a plurality of pallet position areas 20, with each pallet position area 20 being configured to have a pallet 16', 16", **16*a*, 16*a*' positioned therein. While six (6) pallet position areas 20 are shown in each wrapping lane 18 in FIG. 1, it is contemplated that any number of pallet position areas 20 could be included in each of the wrapping lanes 18, including a different number of pallet position areas 20 in each wrapping lane 18. It is further contemplated that each pallet position area 20 can include an outline 22 on a floor 24 of the packaging and shipping facility 10. The outline 22 can be used to visually position the pallet 16', 16", 16*a*, 16*a*' in a proper position in the pallet position area 20 (either by a person or by an automated optical recognition system). For illustration purposes, the left wrapping lane 18 as viewed in FIG. 1 includes two pallet position areas 20 without a pallet 16', 16", 16*a*, 16*a*' thereon, an empty pallet 16', two partially filled pallets 16" and a full pallet 16*a***.

In the illustrated example, the portable wrapping machine 100 moves along the wrapping lane 18 (one portable wrapping machine 100 for each wrapping lane 18) to wrap the full pallets **16*a*. As shown in FIG. 1, each wrapping lane 18 includes a wrapping machine track 26, with the portable wrapping machine 100 moving along the wrapping machine track 26 to each of the pallet position areas 20 to wrap a full pallet 16*a*. The wrapping machine track 26 can be any track 26 that allows the portable wrapping machine 100 to move along the track 26. In the illustrated example, the wrapping machine track 26 is a small groove in the floor 24 of the packaging and shipping facility 10 running adjacent to each of the pallet position areas 20. However, the track 26 could be any mechanical or optical or other device that maintains the portable wrapping machine 100 along a desired path. It is contemplated that each of the pallet position areas 20 could include an optical design 28 (e.g., a QR code) on the floor 24 for scanning by the portable wrapping machine 100 to allow the portable wrapping machine 100 to be correctly positioned at the pallet position areas 20 with a full pallet 16*a* ready to wrapped therein. Once the full pallet 16*a* is wrapped by the portable wrapping machine 100, a wrapped pallet 16*a*' can be moved by a forklift 36** (either moved by a control system or driven by a person) to a truck, shipping container or shipping staging area.

The illustrated wrapping lane 18 includes an end location 30 at an end thereof. The end location 30 of the wrapping lane 18 can include at least one bumper 32 to ensure that the portable wrapping machine 100 stops at the end location 30 of the wrapping lane 18. A charger 34 can be located adjacent the end location 30 to charge the portable wrapping machine 100. It is contemplated that the charger 34 can be a cord for plugging into the portable wrapping machine 100 for charging a battery system of the portable wrapping machine 100 or can be an inductive charger for allowing the charger 34 to charge the battery system of the portable wrapping machine 100 when the portable wrapping machine 100 is at the end location 30. While the end location 30 is shown as having a pallet position area 20 to allow wrapping of a full pallet **16*a* in the pallet position area 20 at the end location 30 while simultaneously charging the portable wrapping machine 100, it is contemplated that the end location 30 could be spaced from any pallet position area 20**.

In the illustrated example, the portable wrapping machine 100 (FIGS. 2-15) is moved along the wrapping lane 18 to wrap the full pallet **16*a* with stretch wrap. The portable wrapping machine 100 includes a frame 102 for moving along the track 26 to the pallet position area 20 with the full pallet 16*a* therein. Each portable wrapping machine 100 includes a wrapping arm assembly 104 for wrapping the full pallet 16*a* and a grip and cut assembly 106 for gripping the stretch wrap film during the initiation of a wrapping process and for cutting the stretch wrap film when the wrapping process is complete. The portable wrapping machine 100 includes a fence system 108 for surrounding an interior space 110 of the portable wrapping machine 100 from before the initiation of the wrapping process until the wrapping process is complete. The fence system 108 is designed to keep people and other items out of the interior space 110 of the portable wrapping machine 100** for safety.

Figure 15:
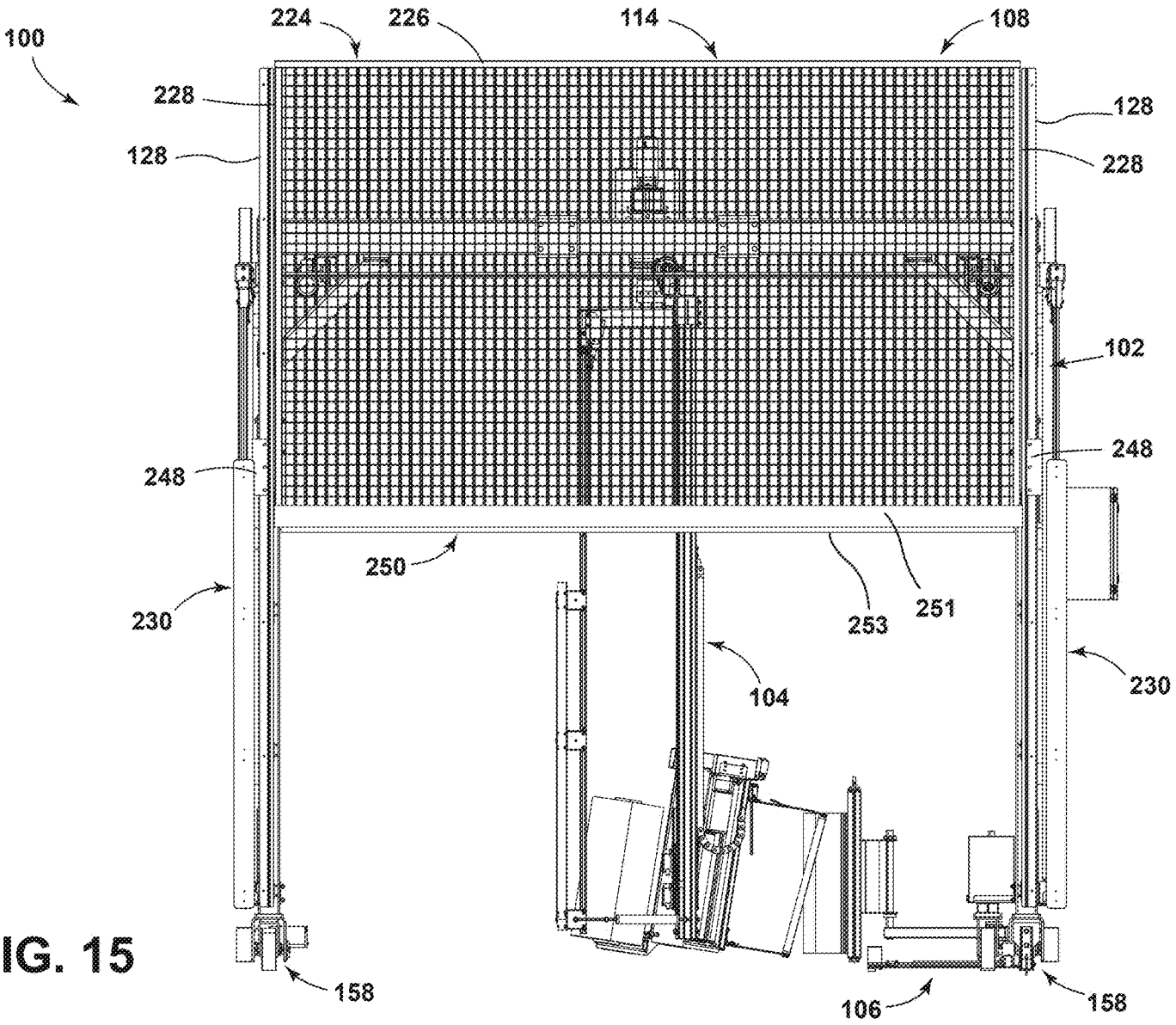
FIG. 15 is a front view of the portable wrapping machine of the present invention with movable gates in a raised position.
Figure 16:
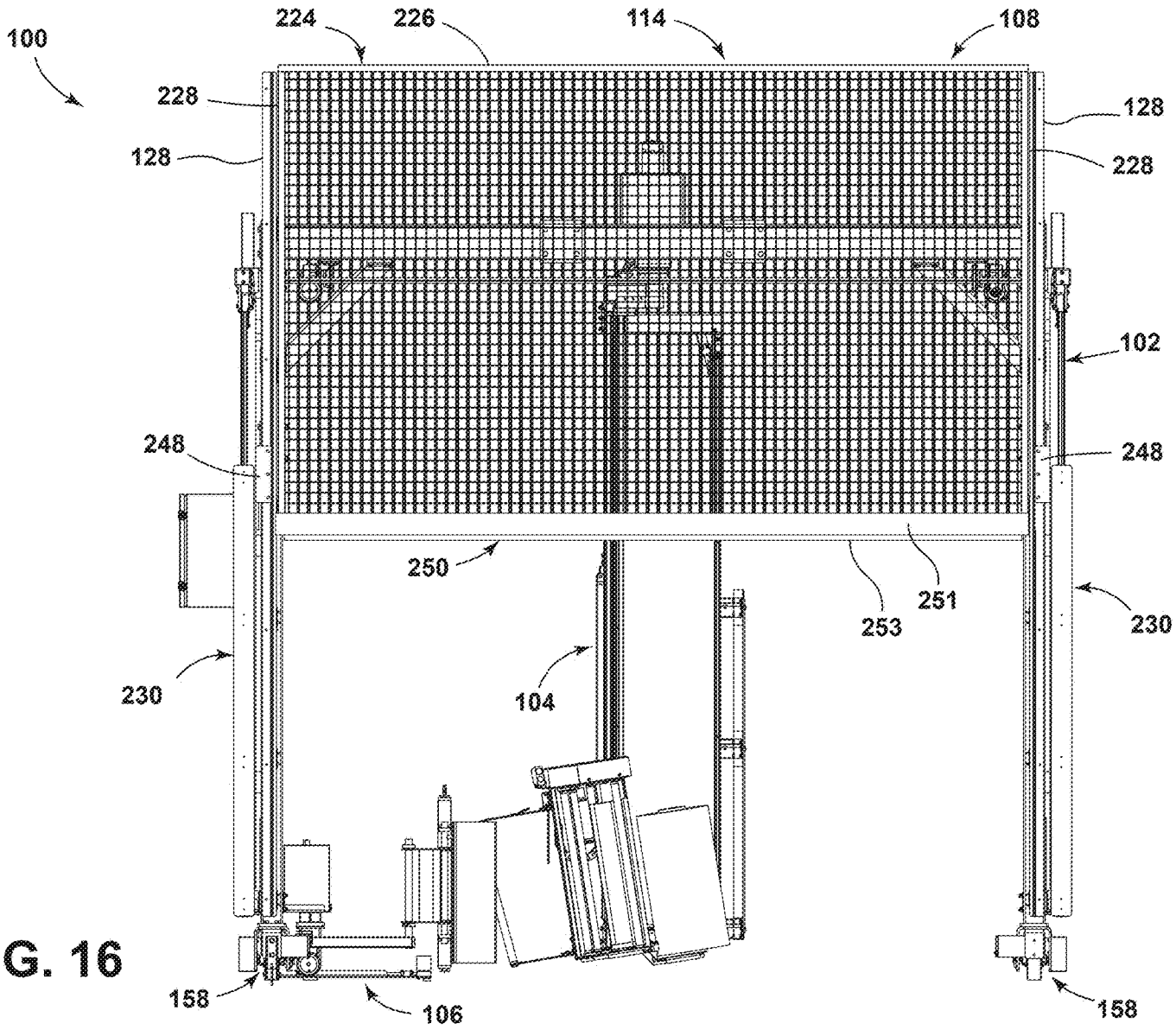
FIG. 16 is a rear view of the portable wrapping machine of the present invention with movable gates in a raised position.

The illustrated fence system 108 includes a pair of fixed side fences 112 and a pair of movable gates 114. Each of the movable gates 114 can be moved (e.g., raised as shown in FIGS. 15 and 16) during movement of the portable wrapping machine 100 along the track 26 to and from different pallet position areas 20. Once the portable wrapping machine 100 is in position to wrap the full pallet 16*a*, the movable gates 114 are moved into position (e.g., lowered) to surround the interior space 110 of the portable wrapping machine 100. The movable gates 114 are moved out of the way relative to the frame 102 to allow the portable wrapping machine 100 to pass over empty pallets 16', partially filled pallets 16" and even full pallets 16*a* (if desired). It is noted that the fence system 108 of the portable wrapping machine 100 is not shown in FIGS. 4-12 to easily identify the remaining elements of the portable wrapping machine 100.

Figure 11:
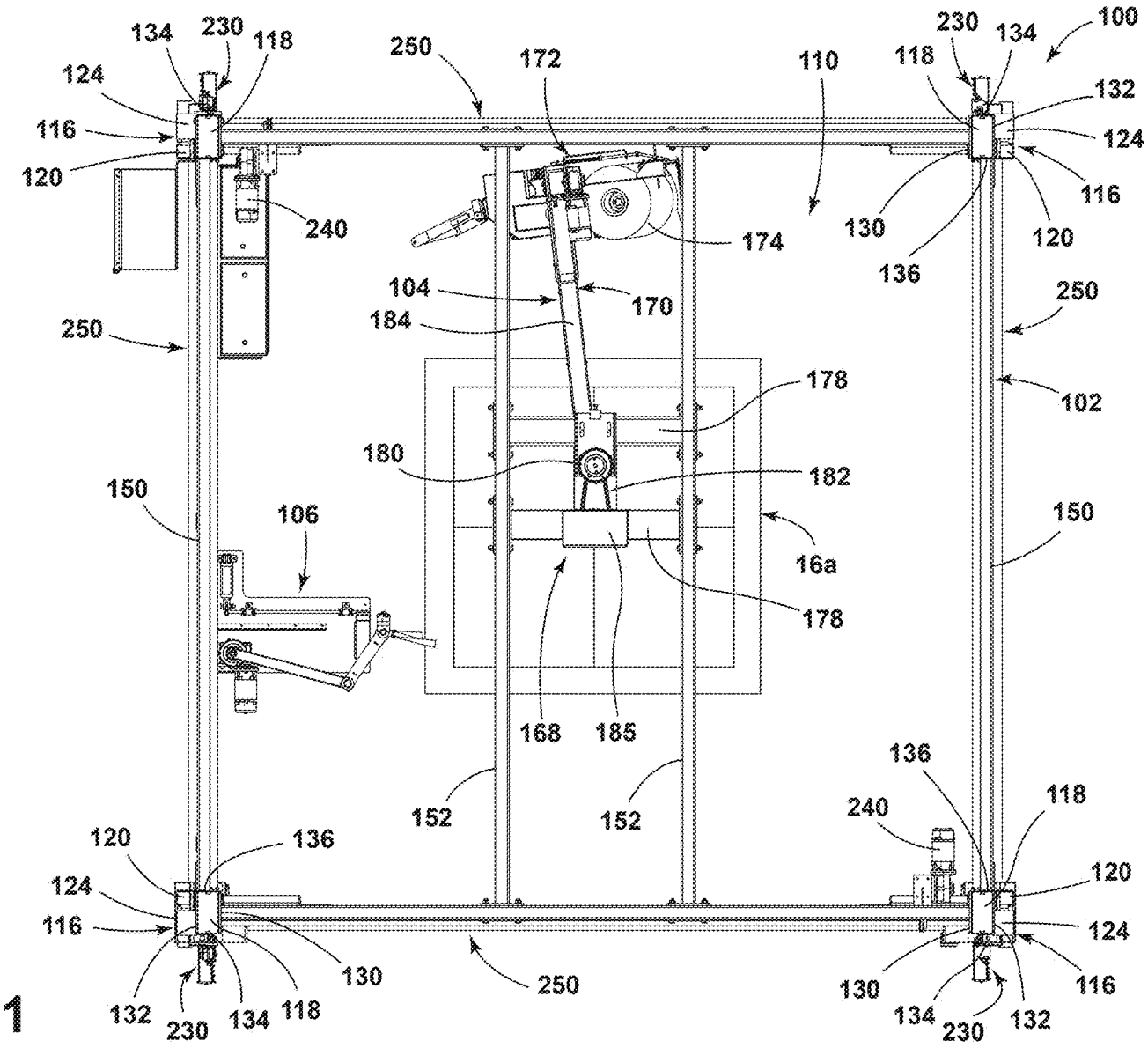
FIG. 11 is a top view of the portable wrapping machine of the present invention with the fence system of the portable wrapping machine removed in order to easily identify the remaining elements of the portable wrapping machine along with illustrating a full pallet to be wrapped.
Figure 12:
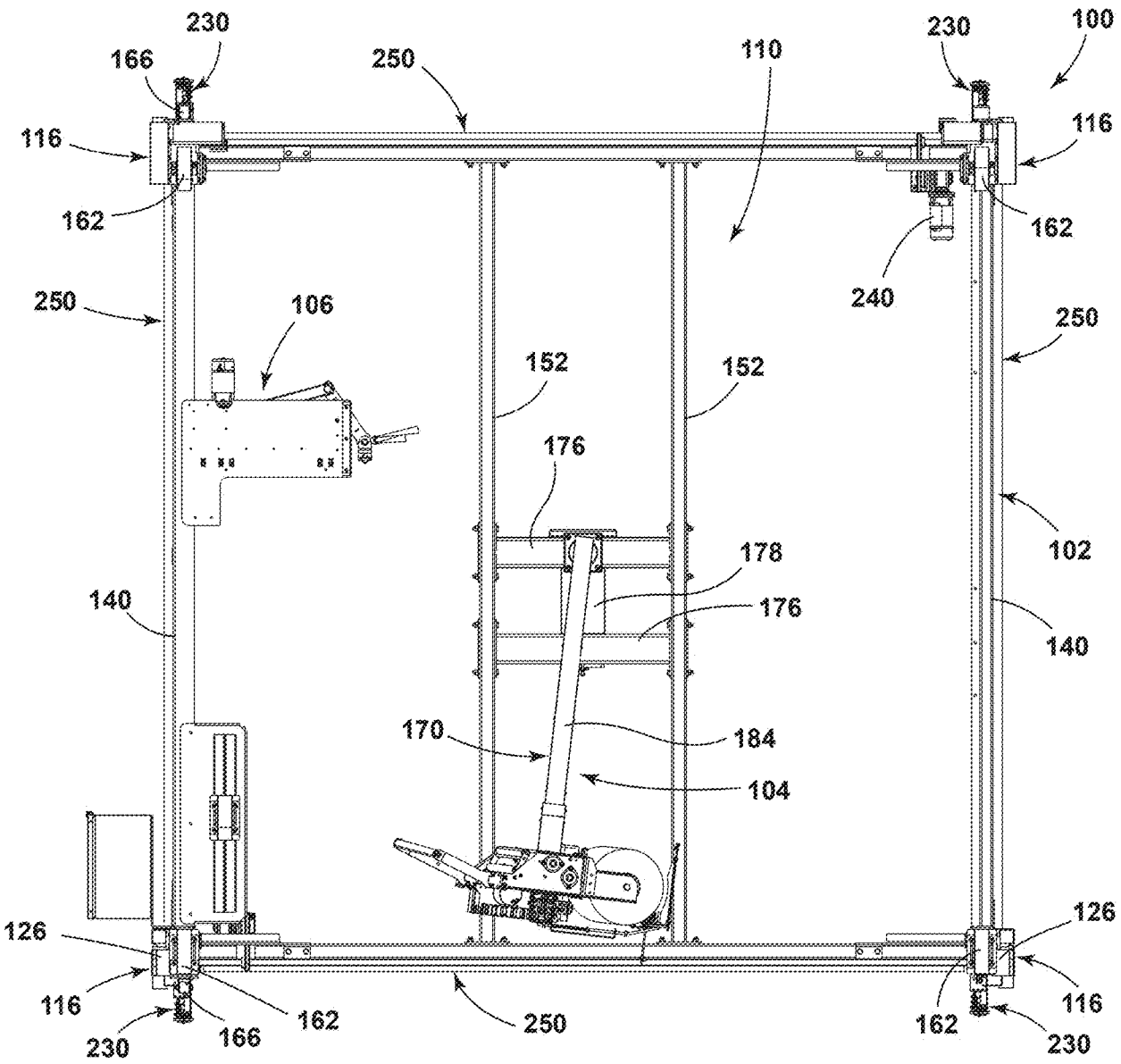
FIG. 12 is a bottom view of the portable wrapping machine of the present invention with the fence system of the portable wrapping machine removed in order to easily identify the remaining elements of the portable wrapping machine.
Figure 13:
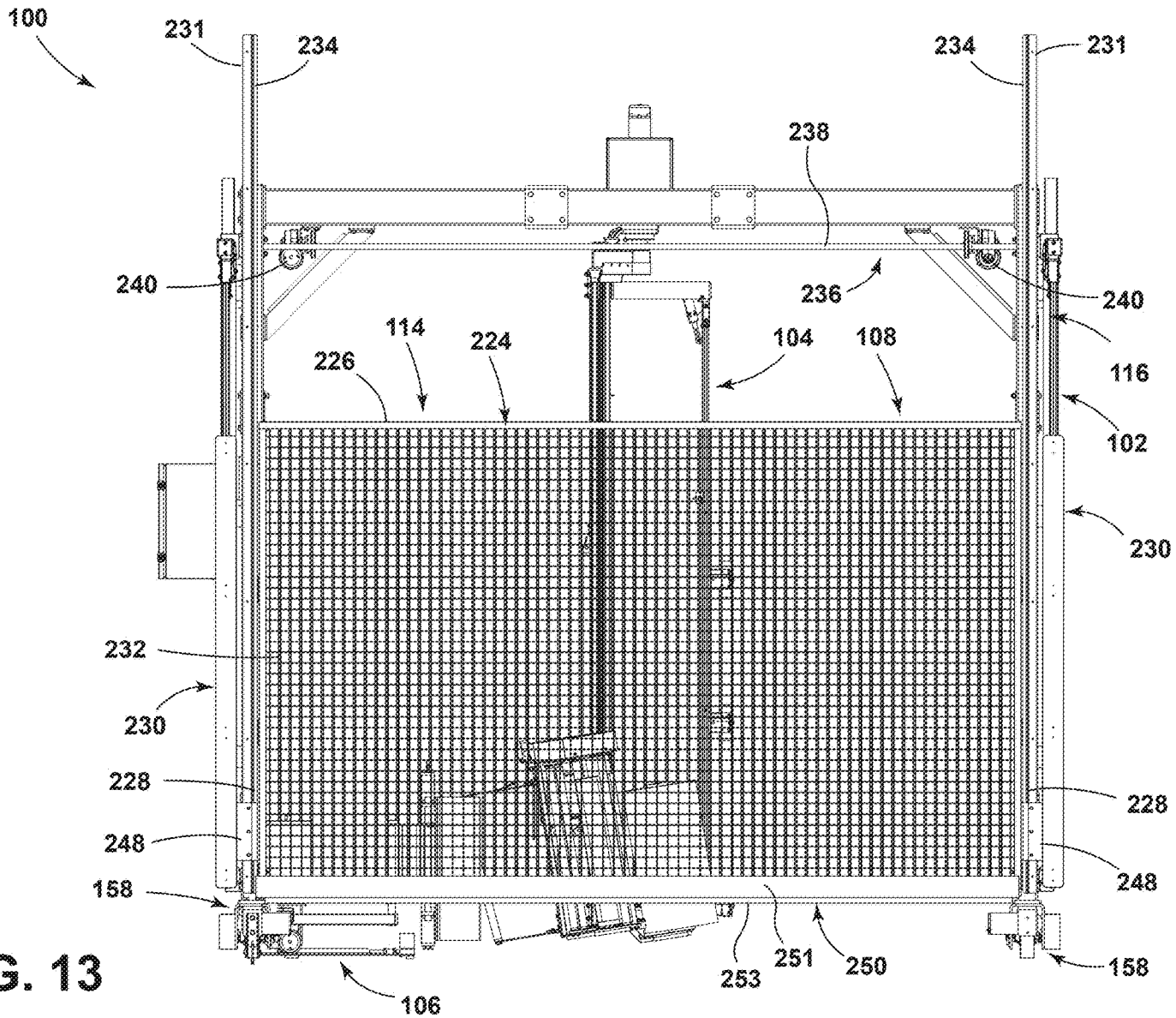
FIG. 13 is a front view of the portable wrapping machine of the present invention with movable gates in a lowered position.
Figure 14:
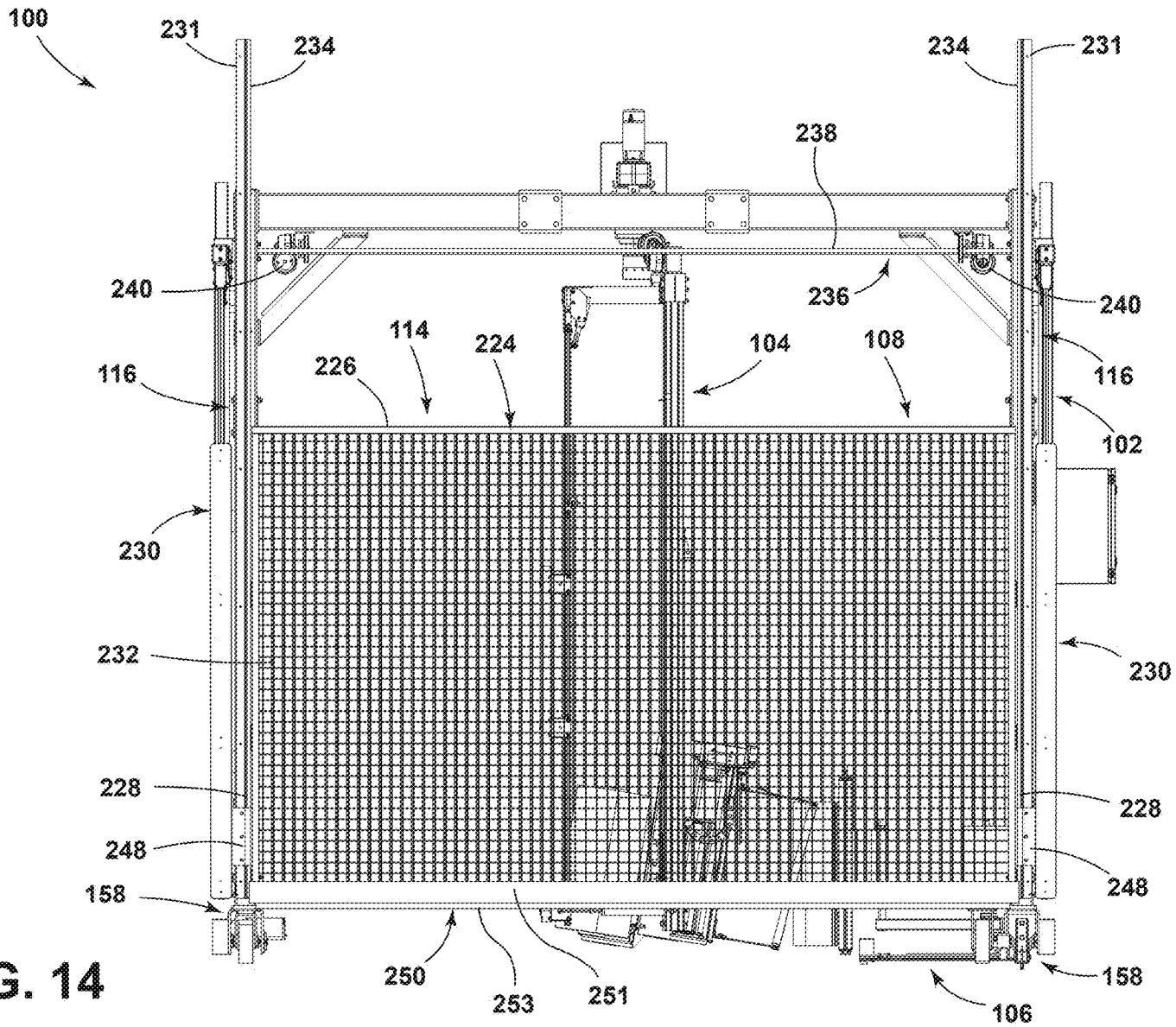
FIG. 14 is a rear view of the portable wrapping machine of the present invention with movable gates in a lowered position.

The illustrated frame 102 of the portable wrapping machine 100 supports the wrapping arm assembly 104, the grip and cut assembly 106, and the fence system 108, along with moving the portable wrapping machine 100. The illustrated frame 102 is substantially cubic in shape and includes a vertically extending upright 116 at each corner thereof. Each upright 116 includes a main support beam 118, a secondary support beam 120, a U-shaped sleeve 122, an upper axel cover 124, a lower axel cover 126 and a gate track 128. As shown in FIG. 11, the main support beam 118 has a substantially rectangular cross-section and includes an inner face 130, an outer face 132, a track face 134 having the gate track 128 connected thereto, and a stationary fence side face 136. The secondary support beam 120 has a substantially square cross-section, is positioned parallel to the main support beam 118 and is connected to the main support beam 118 by a plurality of support plates 138. The support plates 138 are connected to the stationary fence side face 136 of the main support beam 118 and to the secondary support beam 120 to space the secondary support beam 120 from the outer face 132 of the main support beam 118.

In the illustrated example, the U-shaped sleeve 122 is connected to the secondary support beam 120 and the track face 134 of the main support beam 118 to define a link space between the outer face 132 of the main support beam 118, the secondary support beam 120 and an interior of the U-shaped sleeve 122. The upper axel cover 124 is located at a top of the U-shaped sleeve 122 to define a top of the link space and the lower axel cover 126 is located at a bottom of the U-shaped sleeve 122 to define a bottom of the link space. The gate track 128 is connected to the track face 134 of the main support beam 118. As described in more detail below, the movable gate 114 rides on the gate tracks 128 of a pair of the uprights 116 and a counterweight system is located within the link space to assist in easily raising and lowering the movable gate 114 of the fence system 108.

The illustrated uprights 116 of the frame 102 of the portable wrapping machine 100 are interconnected together to form a solid and stable apparatus. As shown in FIGS. 4-12, the frame 102 includes a pair of lower side beams 140 and a pair of upper cross beams 142. The pair of lower side beams 140 have a substantially U-shaped cross-sectional shape opening inwardly and extending parallel to the direction of movement of the portable wrapping machine 100, which is also parallel to the fixed side fences 112 and perpendicular to the movable gates 114. Each of the lower side beams 140 has ends that terminate in a connection plate 144 that is affixed to the stationary fence side face 136 of the main support beam 118 of one of the uprights 116 at the bottom thereof (see, for example, FIGS. 4 and 5).

In the illustrated example, the pair of upper cross beams 142 have a substantially rectangular cross-sectional shape and extend perpendicular to the pair of lower side beams 140 and the direction of movement of the portable wrapping machine 100. Each of the upper cross beams 142 has ends that terminate in a connection plate 146 that is affixed to the inner face 130 of the main support beam 118 of one of the uprights 116 at the top thereof (see, for example, FIGS. 4 and 5). An angled strut 148 extends between and is connected to the inner face 130 of the main support beam 118 and a bottom of the upper cross beams 142 at each intersection of the upright 116 and the upper cross beams 142.

The illustrated frame 102 further includes fence support side beams 150 to further provide stability for the portable wrapping machine 100. In the illustrated example, each side of the frame 102 includes a pair of the fence support side beams 150 extending between a pair of the uprights 116. Each of the fence support side beams 150 has a substantially U-shaped cross-sectional shape opening inwardly and extends parallel to the direction of movement of the portable wrapping machine 100. As shown in FIGS. 2, 3 and 13-15, one of the fence support side beams 150 is located at a top of the fixed side fences 112 and one of the fence support side beams 150 is located at a bottom of the fixed side fences 112. Connection plates 154 are connected to outer faces of each end of the fence support side beams 150 and to the outer face 132 of the main support beam 118 of one of the uprights 116 to connect the fence support side beams 150 to the uprights 116.

In the illustrated example, a pair of parallel wrapping arm support beams 152 extend between the pair of upper cross beams 142 to further provide stability for the portable wrapping machine 100 and to support the wrapping arm assembly 104. Each of the wrapping arm support beams 152 has a substantially rectangular cross-sectional shape. As discussed in more detail below, the pair of parallel wrapping arm support beams 152 support an inverted L-shaped wrapping arm 170 of the wrapping arm assembly 104 to rotate about a stationary point.

The frame 102 as described herein is merely an example of a structure of a frame 102 that can be used with the portable wrapping machine 100 as discussed herein. The frame 102 should support the fence system 108 and the wrapping arm assembly 104 for allowing the portable wrapping machine 100 to move to various locations to wrap a full pallet 16*a*. The frame 102 includes a movement system for allowing the frame 102 to move.

The illustrated movement system for the frame 102 allows the portable wrapping machine 100 to be moved to a desired location. As illustrated in FIGS. 2-16, each of the uprights 116 has a wheel assembly 158 connected to a bottom thereof. Each wheel assembly 158 includes a wheel support 160 that holds a wheel 162 for allowing all of the wheels 162 to travel along a line. The illustrated wheels 162 have a fixed axle such that the wheels 162 can only move along a line. However, it is contemplated that the wheels could swivel if the portable wrapping machine 100 is configured to move in multiple directions. It is further contemplated that the wheels 162 could be configured to allow the portable wrapping machine 100 to move in an arc or a circle. In the illustrated example, an opposite pair of wheels 162 includes a drive 164 for driving the wheels 162 and therefore the portable wrapping machine 100 along the wrapping lane 18 to a desired location. However, it is contemplated that any number of the wheels 162 (including only one) could be driven.

To ensure that the portable wrapping machine 100 stays in position as the portable wrapping machine 100 moves along the wrapping lane 18, the portable wrapping machine 100 can include a steering system. For example, the wheels 162 could be configured as a train wheel or a rail wheel to travel along the track 26. In the present example, the portable wrapping machine 100 includes a plurality of auxiliary wheels 166 for traveling in the track 26. Each auxiliary wheel 166 is disc shaped and travels along a position lower than the wheels 162. In this example, the track 26 is a thin groove in the floor 24 of the shipping area 14 of the packaging and shipping facility 10. The auxiliary wheel 166 rides in the track 26 as the drive 164 moves the wheels 162 to a desired location. As shown, a pair of parallel auxiliary wheels 166 are located along one side of the frame 102 and are connected to the uprights 116 or the wheel assembly 158. This pair of parallel auxiliary wheels 166 are located with one in front of a wheel 162 in a direction of travel and one behind a wheel 162 in a direction of travel (no matter which direction the portable wrapping machine 100 is travelling in the wrapping lane 18), although the auxiliary wheels 166 could be on an opposite side of the wheel 162. It is contemplated that the floor 24 of the shipping area 14 of the packaging and shipping facility 10 could include a pair of parallel tracks 26 with each side of the frame 102 including a pair of auxiliary wheels 166 (or possibly even a single auxiliary wheel 166 on each side of the frame 102). It is further contemplated that the frame 102 could include brushes or a scoop plate that travels in the track 26 in front of and/or behind each of the auxiliary wheels 166 to ensure that the track 26 remains free of debris.

In the illustrated example, once the portable wrapping machine 100 is in position about a full pallet 16*a* (e.g., as shown in FIG. 1) and the movable gates 114 are in the lowered position (as discussed below), the wrapping arm assembly 104 wraps the boxes 12 on the full pallet 16*a* with wrap film. The wrapping arm assembly 104 includes a motor and arm support assembly 168, an inverted L-shaped wrapping arm 170, and a carriage 172 that rides vertically on the inverted L-shaped wrapping arm 170. Wrap film is pulled from a roll 174 of wrap film on the carriage 172 to wrap the boxes 12 while the inverted L-shaped wrapping arm 170 rotates about the goods on the full pallet 16*a*.

Figure 5:
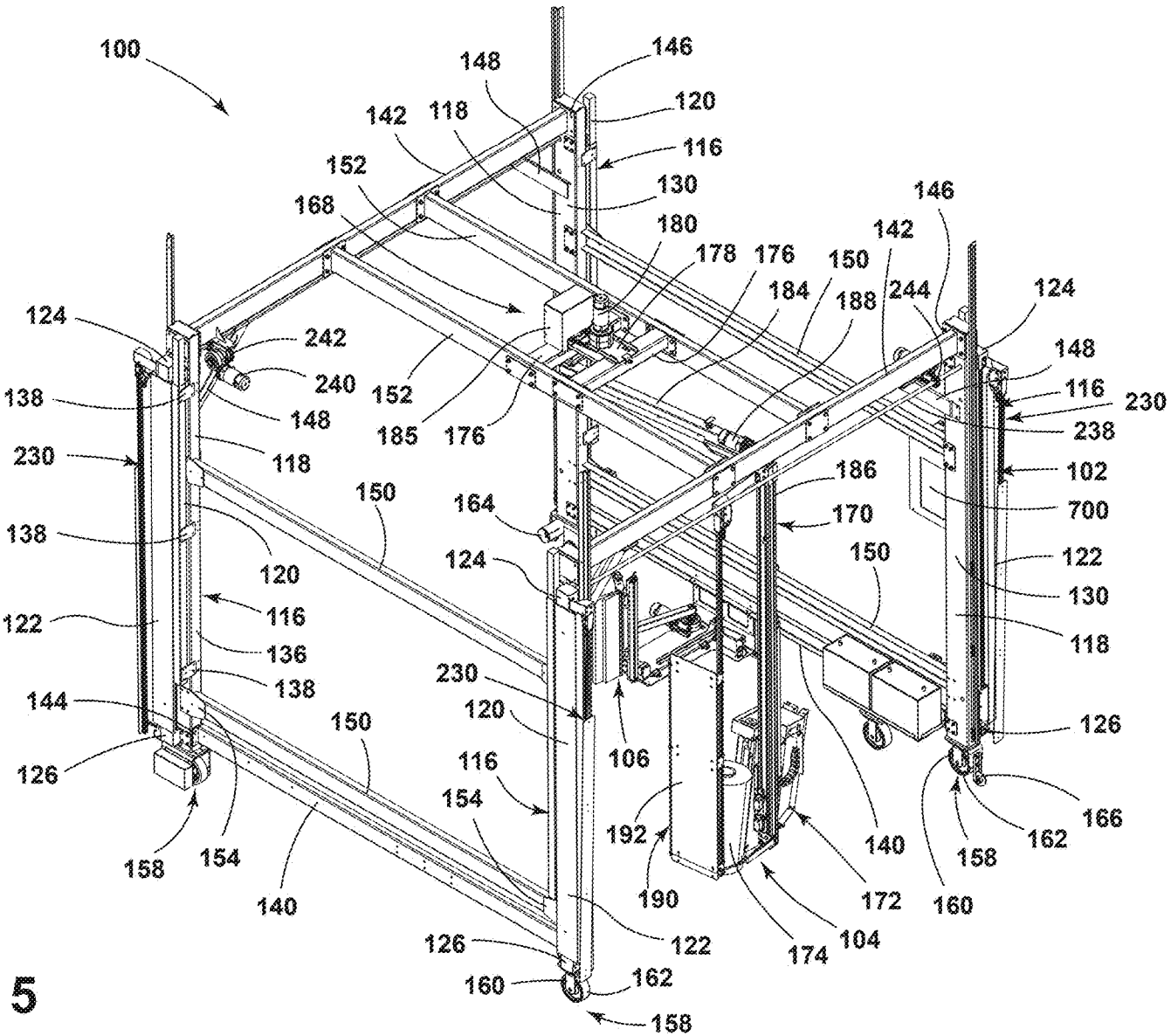
FIG. 5 is a second front perspective view of the portable wrapping machine of the present invention with the fence system of the portable wrapping machine removed in order to easily identify the remaining elements of the portable wrapping machine.

The illustrated motor and arm support assembly 168 supports the inverted L-shaped wrapping arm 170 and the carriage 172 and provides power to the inverted L-shaped wrapping arm 170 for rotating the inverted L-shaped wrapping arm 170. The motor and arm support assembly 168 includes a pair of support crossbeams 176 that extend between the wrapping arm support beams 152. A support plate 178 extends between the pair of support crossbeams 176 and is connected to top surfaces thereof. A first motor 180 is located on a top of the support plate 178 and can be powered by a battery and/or a power source. The first motor 180 rotates the inverted L-shaped wrapping arm 170 by a gear thereof winding an endless link 182 (or similar device) about a wrapping axle or gear connected to a top of the inverted L-shaped wrapping arm 170. The wrapping axle or gear connected to a top of the inverted L-shaped wrapping arm 170 and the interaction of the wrapping axle or gear and the endless link 182 is covered by an arm cover 185 covering both the wrapping axle or gear and a portion of the endless link 182 as shown in FIGS. 5 and 11. The arm cover 185 is connected to a top of the support plate 178.

In the illustrated example, the inverted L-shaped wrapping arm 170 rotates about the full pallet 16*a* to wrap the full pallet 16*a* with the wrap film. The inverted L-shaped wrapping arm 170 includes a horizontal portion 184 and a vertical portion 186. The carriage 172 is connected to the vertical portion 186 and is configured to move vertically along the vertical portion 186 of the inverted L-shaped wrapping arm 170. An inner end of the horizontal portion 184 of the inverted L-shaped wrapping arm 170 is connected to the wrapping axle or gear and rotates with the wrapping axle or gear. A second motor 188 is located at a distal end of the horizontal portion 184 of the inverted L-shaped wrapping arm 170. The second motor 188 can be powered by a battery and/or a power source. The second motor 188 includes a spool that is rotated by the motor thereof. A cable extending along the vertical portion 186 is configured to be selectively pulled and wrapped onto the spool or unwound from the spool to raise and lower the carriage 172 as is well known to those skilled in the art. Although a particular location of the first motor 180 and the second motor 188 is shown in the drawings for rotating the inverted L-shaped wrapping arm 170 and raising and lowering the carriage 172, it is contemplated that any system of motors, wheels and/or pulleys could be employed to rotate the inverted L-shaped wrapping arm 170 along with raising and lowering the carriage 172.

The illustrated carriage 172 includes the roll 174 of the wrap film used to wrap the full pallet 16*a*. In the illustrated example, the wrap is pre-stretched before being wrapped about the full pallet 16*a* using pre-stretch rollers on the carriage 172 as is well known to those skilled in the art. However, it is contemplated that the carriage 172 could pre-stretch the wrap in order to lengthen the wrap in a manner known to those skilled in the art. The carriage 172 can be any carriage 172 known to those skilled in the art. For example, the carriage 172 can be identical to the carriage 18 disclosed in U.S. Patent Application Publication No. 2013/0227919 entitled STRETCH WRAP CARRIAGE THREADING DEVICE, the entire contents of which are incorporated herein by reference. Alternatively, the carriage 172 can be identical to the carriage 24 or the carriage 50 disclosed in U.S. Patent Application Publication No. 2022/0169468 entitled STRETCH WRAP FILM CARRIAGE, the entire contents of which are incorporated herein by reference. Moreover, the inverted L-shaped wrapping arm 170 can be identical to the inverted L-shaped wrapping arm 22 or the inverted L-shaped wrapping arm 22a disclosed in U.S. Pat. No. 11,643,230 entitled ROTARY ARM FOR STRETCH WRAPPING MACHINE, the entire contents of which are incorporated herein by reference. Likewise, the inverted L-shaped wrapping arm 170 can include a bumper system 190 identical to the bumper system 400 disclosed in U.S. Pat. No. 11,643,230 entitled ROTARY ARM FOR STRETCH WRAPPING MACHINE, the entire contents of which are incorporated herein by reference. The bumper system 190 includes a paddle 192 that will stop rotation of the inverted L-shaped wrapping arm 170 when an object strikes the paddle 192 in the same manner in which the L-shaped wrapping arm 22 of U.S. Pat. No. 11,643,230 entitled ROTARY ARM FOR STRETCH WRAPPING MACHINE stops rotating when the paddles 458 of the bumper system 400 of U.S. Pat. No. 11,643,230 are abutted by an object.

Figure 4:
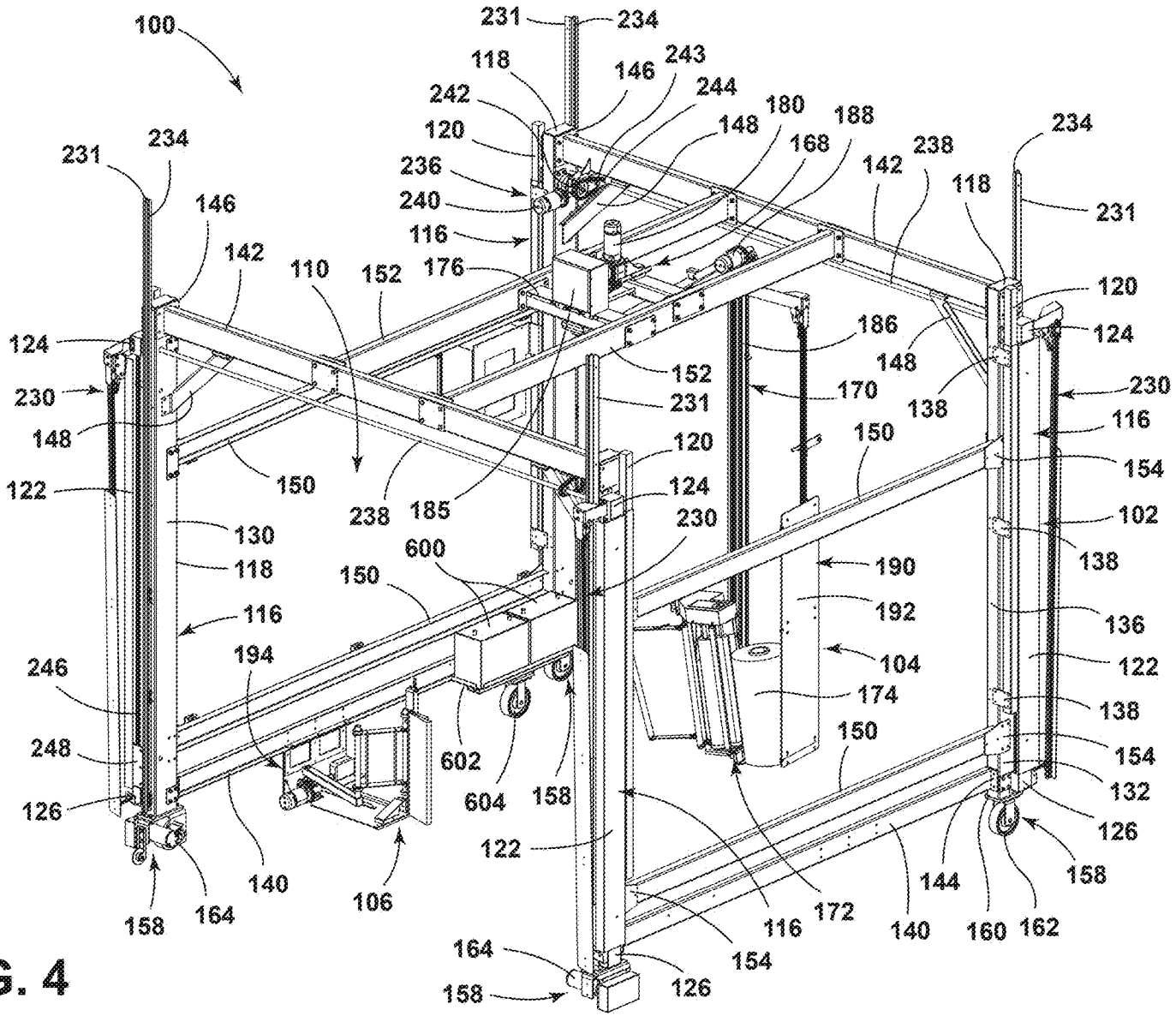
FIG. 4 is a first front perspective view of the portable wrapping machine of the present invention with a fence system of the portable wrapping machine removed in order to easily identify the remaining elements of the portable wrapping machine.
Figure 6:
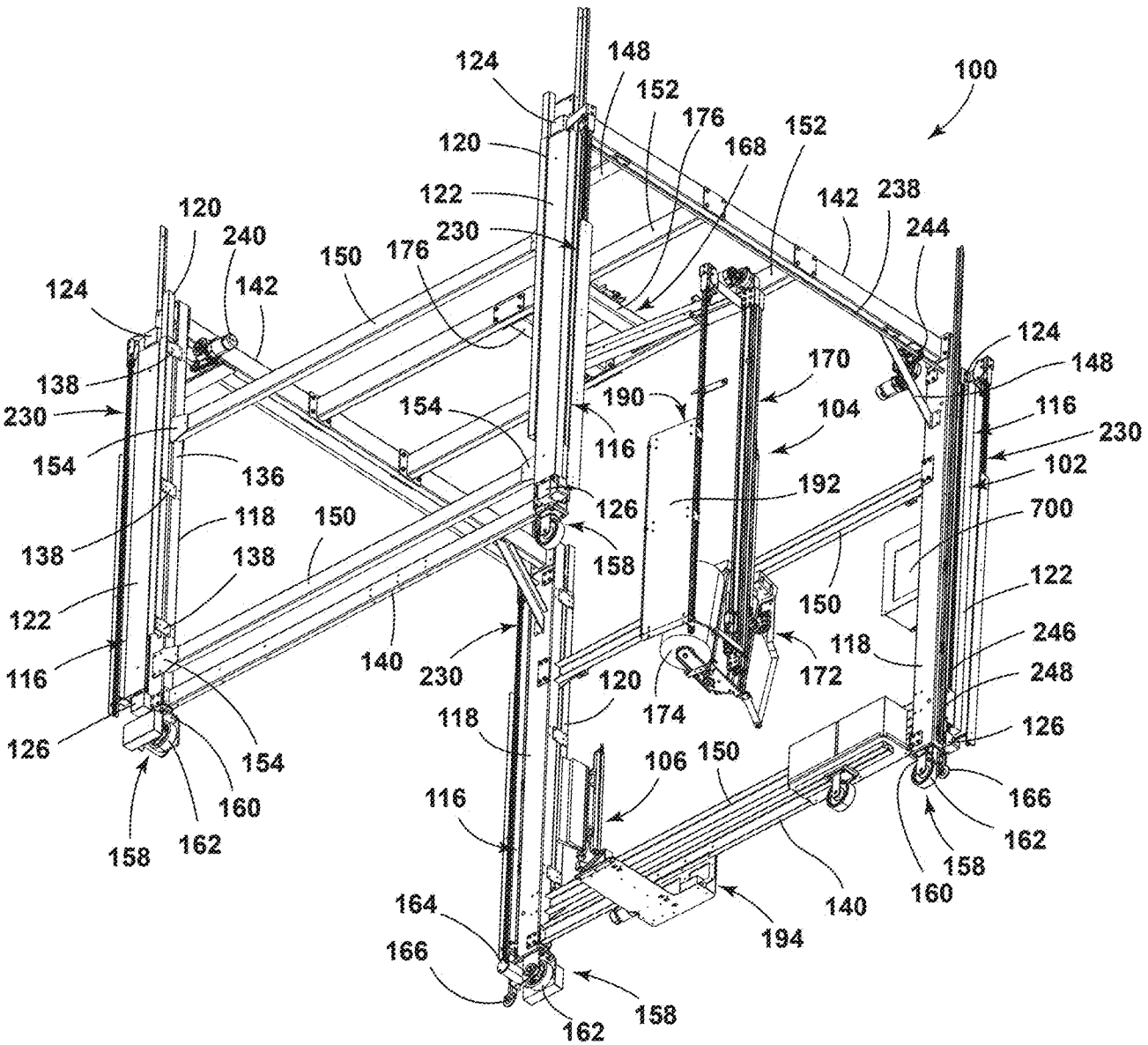
FIG. 6 is a bottom perspective view of the portable wrapping machine of the present invention with the fence system of the portable wrapping machine removed in order to easily identify the remaining elements of the portable wrapping machine.
Figure 7:
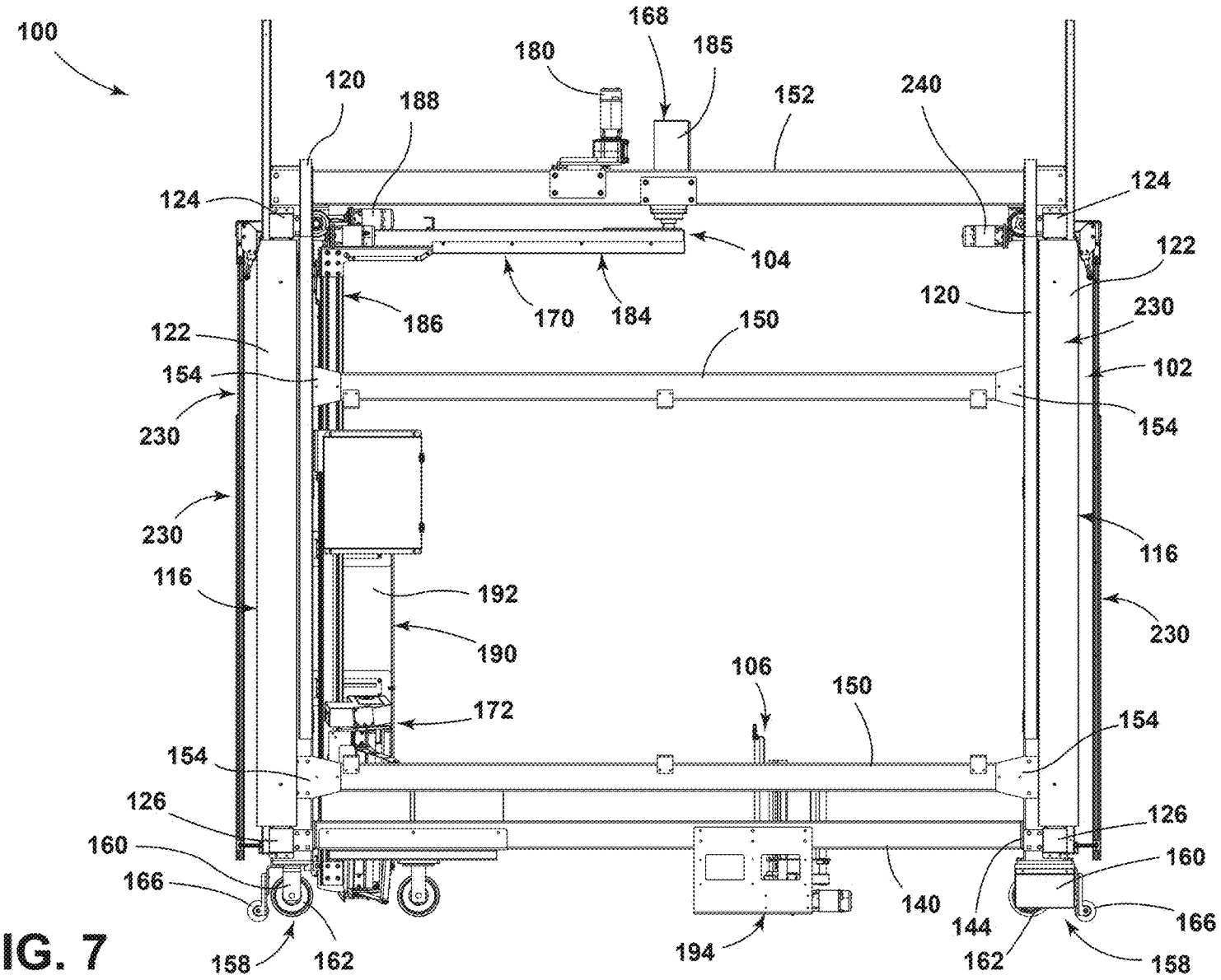
FIG. 7 is a first side view of the portable wrapping machine of the present invention with the fence system of the portable wrapping machine removed in order to easily identify the remaining elements of the portable wrapping machine.
Figure 8:
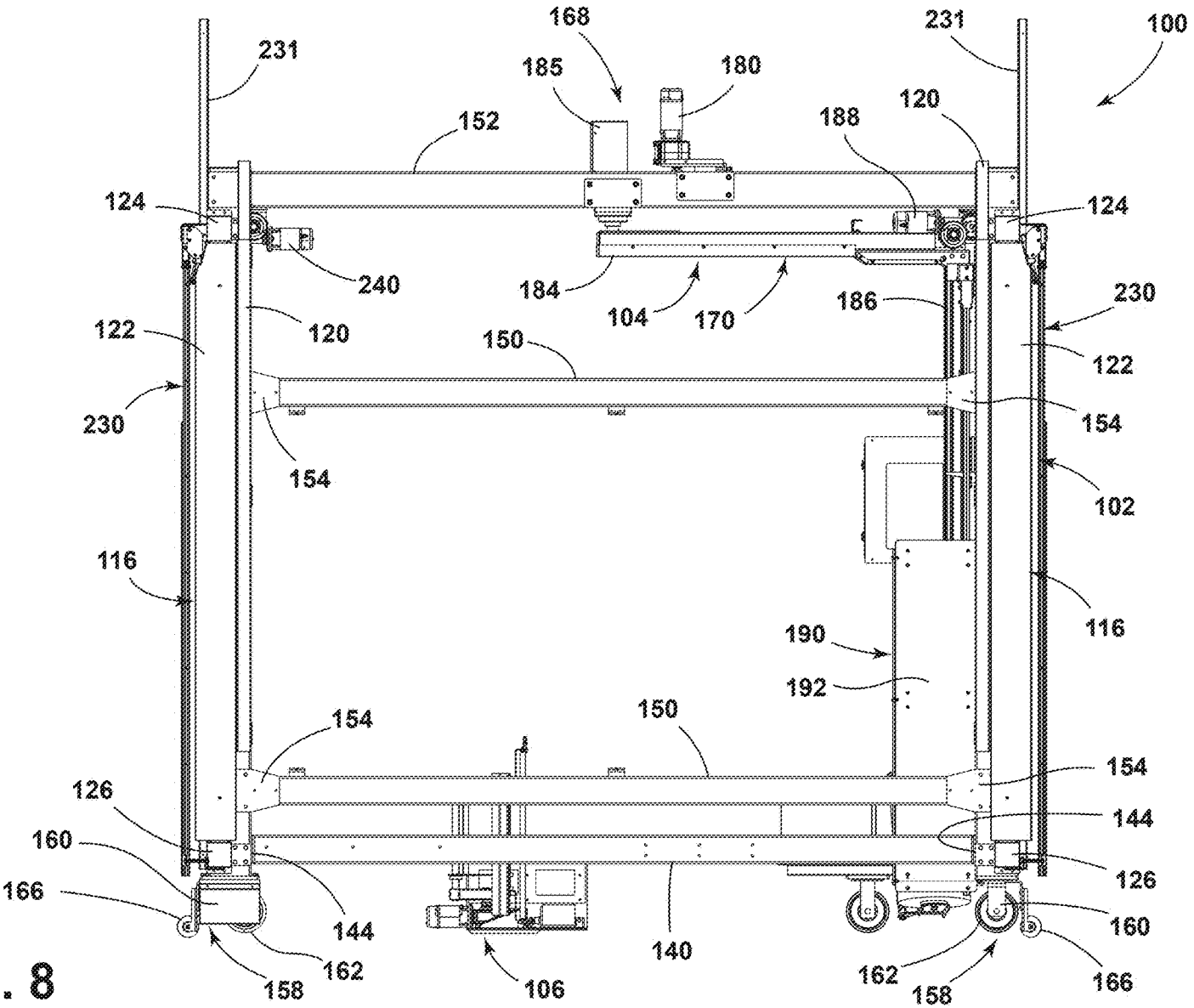
FIG. 8 is a second front perspective view of the portable wrapping machine of the present invention with the fence system of the portable wrapping machine removed in order to easily identify the remaining elements of the portable wrapping machine.
Figure 9:
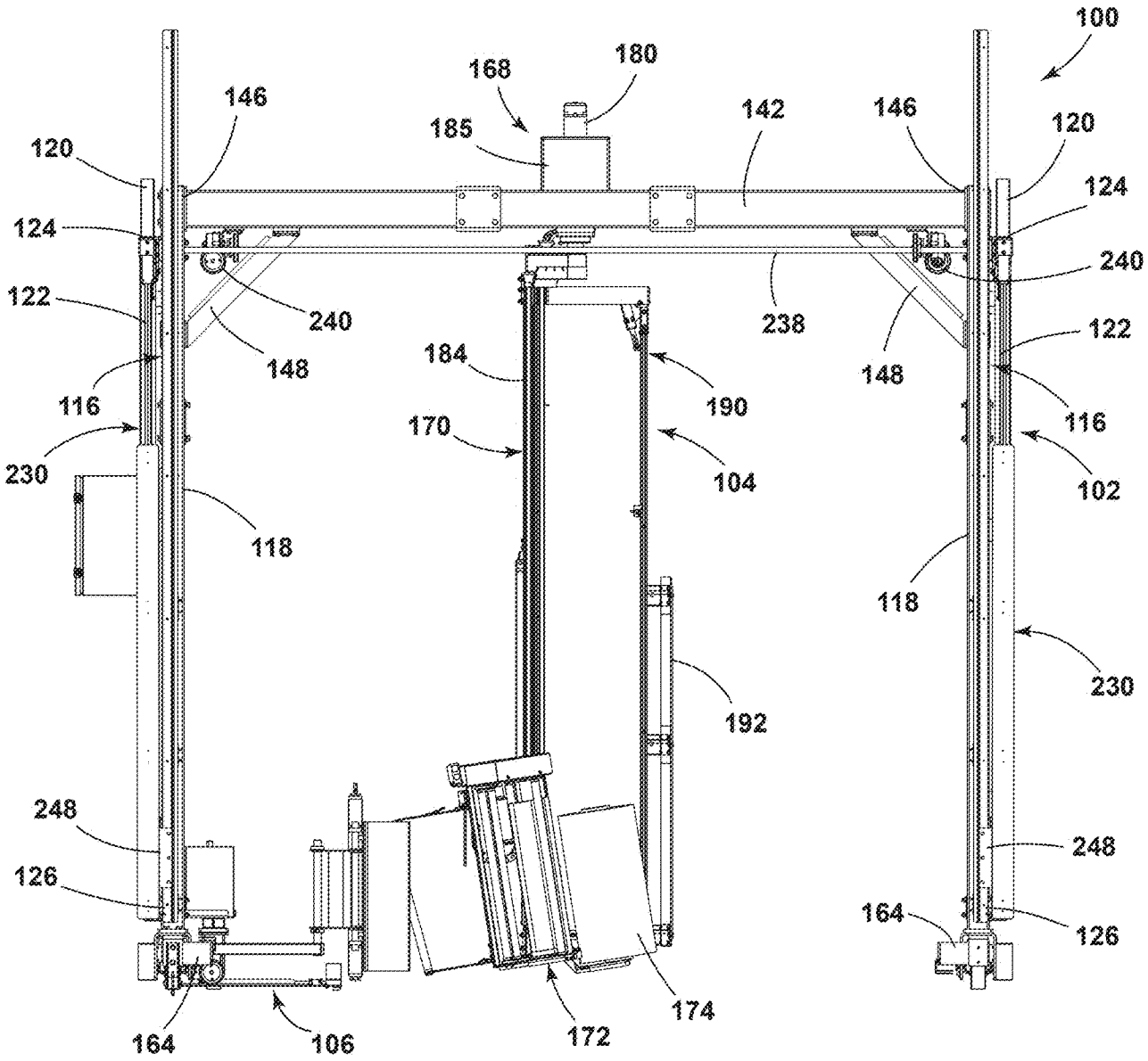
FIG. 9 is a front view of the portable wrapping machine of the present invention with the fence system of the portable wrapping machine removed in order to easily identify the remaining elements of the portable wrapping machine.
Figure 10:
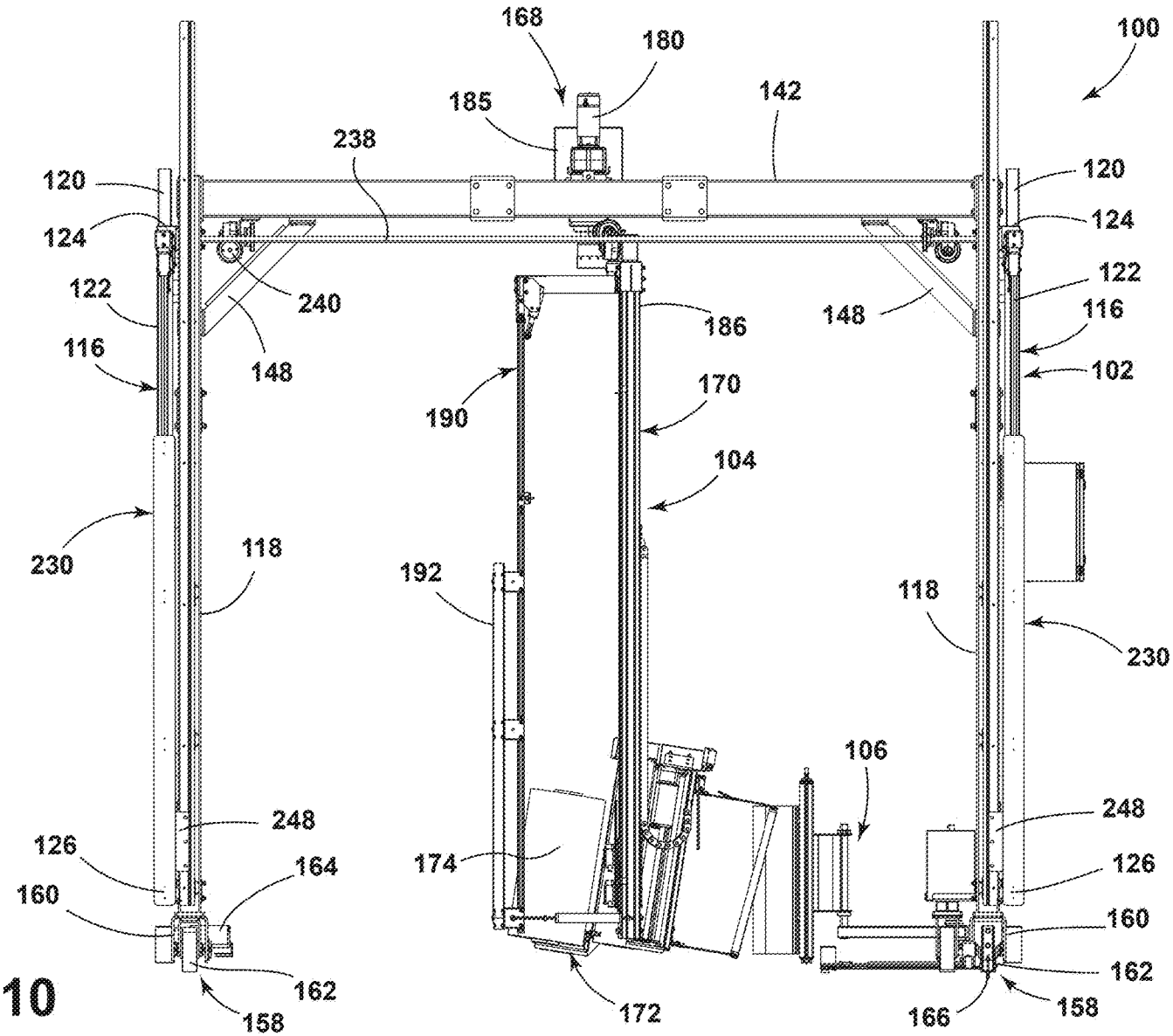
FIG. 10 is a rear view of the portable wrapping machine of the present invention with the fence system of the portable wrapping machine removed in order to easily identify the remaining elements of the portable wrapping machine.

The illustrated portable wrapping machine 100 includes the grip and cut assembly 106 (see FIGS. 21-22) for gripping the stretch wrap at the initiation of a wrapping process and for cutting the stretch wrap when the wrapping process is complete. The grip and cut assembly 106 includes an angled support plate 194 connected to one of the lower side beams 140 of the frame 102 as illustrated in FIGS. 4-6. The angled support plate 194 includes a vertical panel 196 connected to an outer face of the lower side beam 140 and extending downwardly therefrom. The angled support plate 194 also includes a horizontal panel 197 extending inwardly from a bottom of the vertical panel 196. A film clamp assembly 198 is located on the vertical panel 196 as shown in FIGS. 21 and 22.

Figure 21:
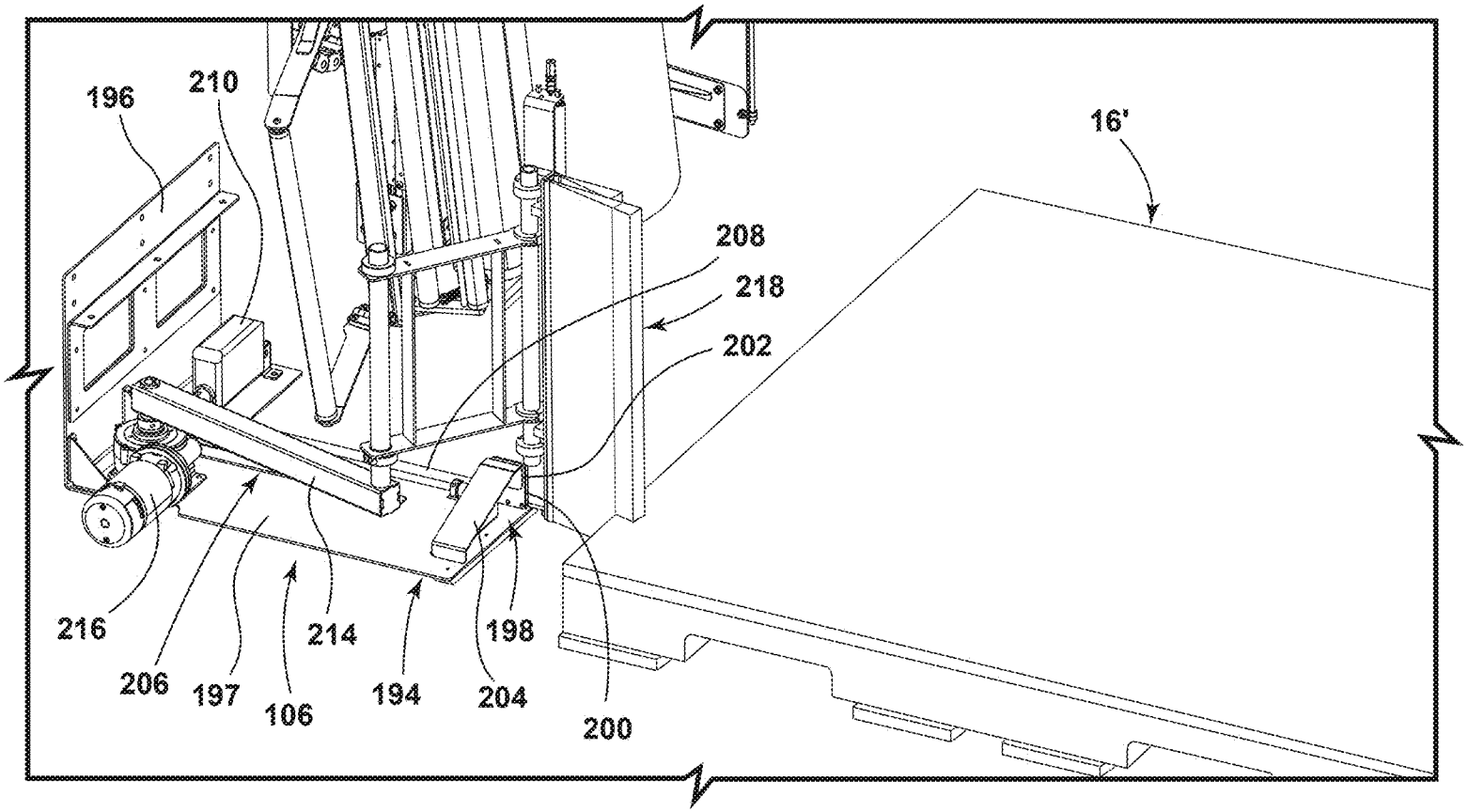
FIG. 21 is a close-up perspective view of a grip and cut assembly of the portable wrapping machine of the present invention adjacent a pallet.
Figure 22:
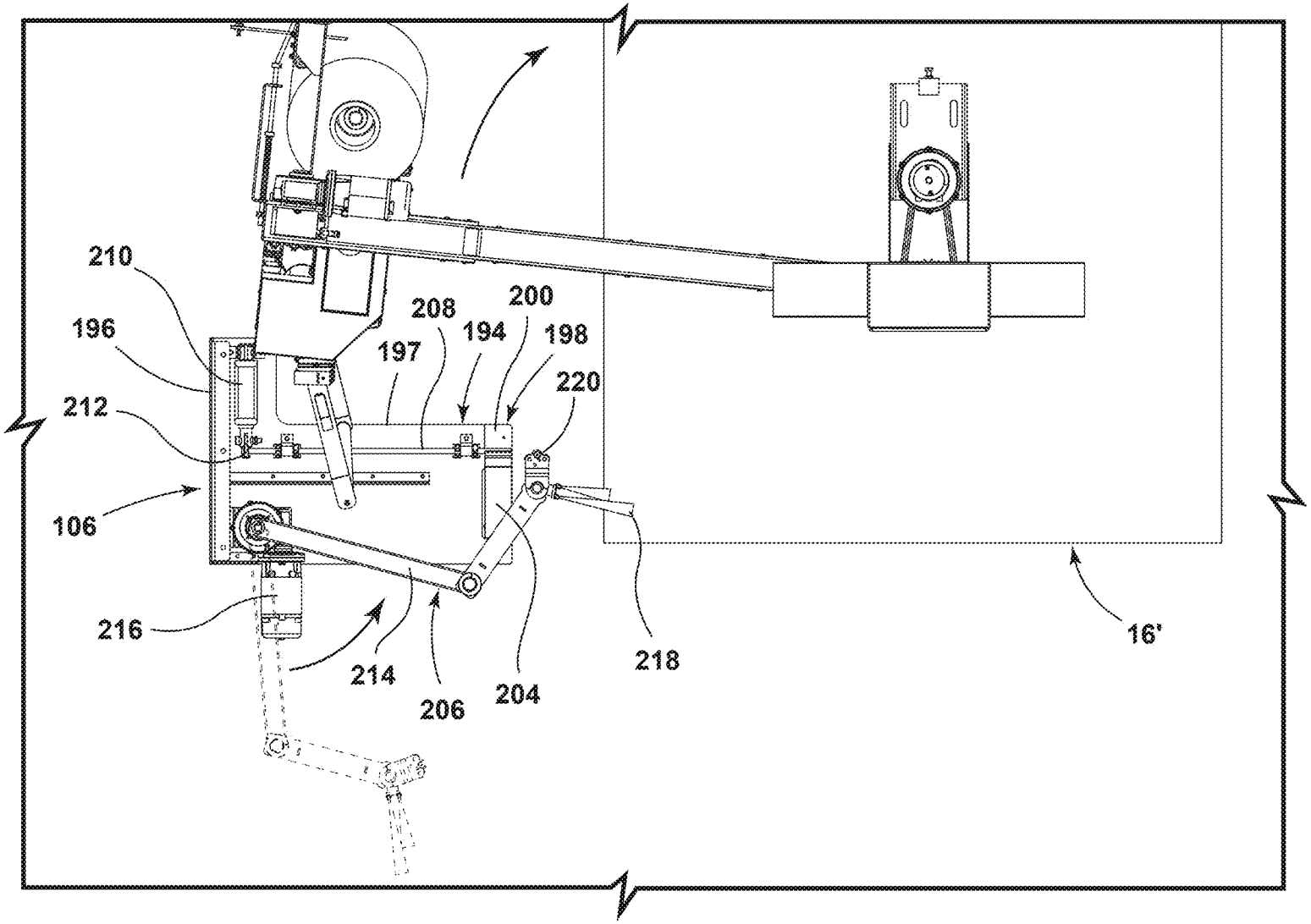
FIG. 22 is a close-up top view of the grip and cut assembly of the portable wrapping machine of the present invention adjacent a pallet.

In the illustrated example, the film clamp assembly 198 includes a rotatable clamp flap 200 that moves from a horizontal position as shown in FIG. 22 to a vertical position as shown in FIG. 21. A rod 208 rotated by a motor 210 via an angle joint 212 rotates the rotatable clamp flap 200 between the vertical position and the horizontal position. At the beginning of the wrapping process, film from the carriage 172 is positioned over the rotatable clamp flap 200 when the rotatable clamp flap 200 is in the horizontal position. The rotatable clamp flap 200 will then rotate to the vertical position to trap the film between the rotatable clamp flap 200 and a pinch plate 202 located at the end of a ramp plate 204 of the film clamp assembly 198. The ramp plate 204 allows the film to ramp over the rotatable clamp flap 200 during wrapping. Once the rotatable clamp flap 200 clamps the film between the rotatable clamp flap 200 and the pinch plate 202, the inverted L-shaped wrapping arm 170 can begin to rotate to wrap the full pallet 16*a* as is well known to those skilled in the art. The film clamp assembly 198 holds an end of the wrap film as the inverted L-shaped wrapping arm 170 makes at least one rotation, thereby pulling film out of the carriage 172. After the film has wrapped upon itself, the rotatable clamp flap 200 can move to the horizontal position, thereby releasing the wrap film.

At the end of the wrap process, the grip and cut assembly 106 can cut the film coming from the carriage 172. The grip and cut assembly 106 includes a brush and cut assembly 206 for finishing the wrapping process. The brush and cut assembly 206 includes a brush arm 214 rotatable about a vertical axis by a motor 216 as shown in FIG. 22. The brush arm 214 has a vertical extending brush 218 at an end thereof and a vertically extending heat wire 220 in front of the brush 218.

Once the full pallet 16*a* is fully wrapped, the grip and cut assembly 106 is activated to cut the end of the film. First, the rotatable clamp flap 200 is once again rotated to the vertical position to trap the film between the rotatable clamp flap 200 and the pinch plate 202. Once the rotatable clamp flap 200 clamps the film between the rotatable clamp flap 200 and the pinch plate 202, the brush arm 214 is rotated toward the full pallet 16*a* and the heat wire 220 is heated. Therefore, the wrap film will simultaneously be cut by the heat wire 220 while the brush 218 on the brush arm 214 brushes the end of the wrap film against the wrap film wrapped about the full pallet 16*a*, with the end of the wrap film adhering to the wrap film already about the full pallet 16*a* (e.g., through electrical attraction). The film from the carriage 172 will then already be clamped between the rotatable clamp flap 200 and the pinch plate 202 to begin a subsequent wrapping process after the portable wrapping machine 100 has moved to another full pallet 16*a*. While a particular clamping and cutting process is shown and described herein, it is contemplated that other assemblies can be used to hold the wrap during wrapping and cutting the wrap film after the wrapping process is complete.

Figure 3:
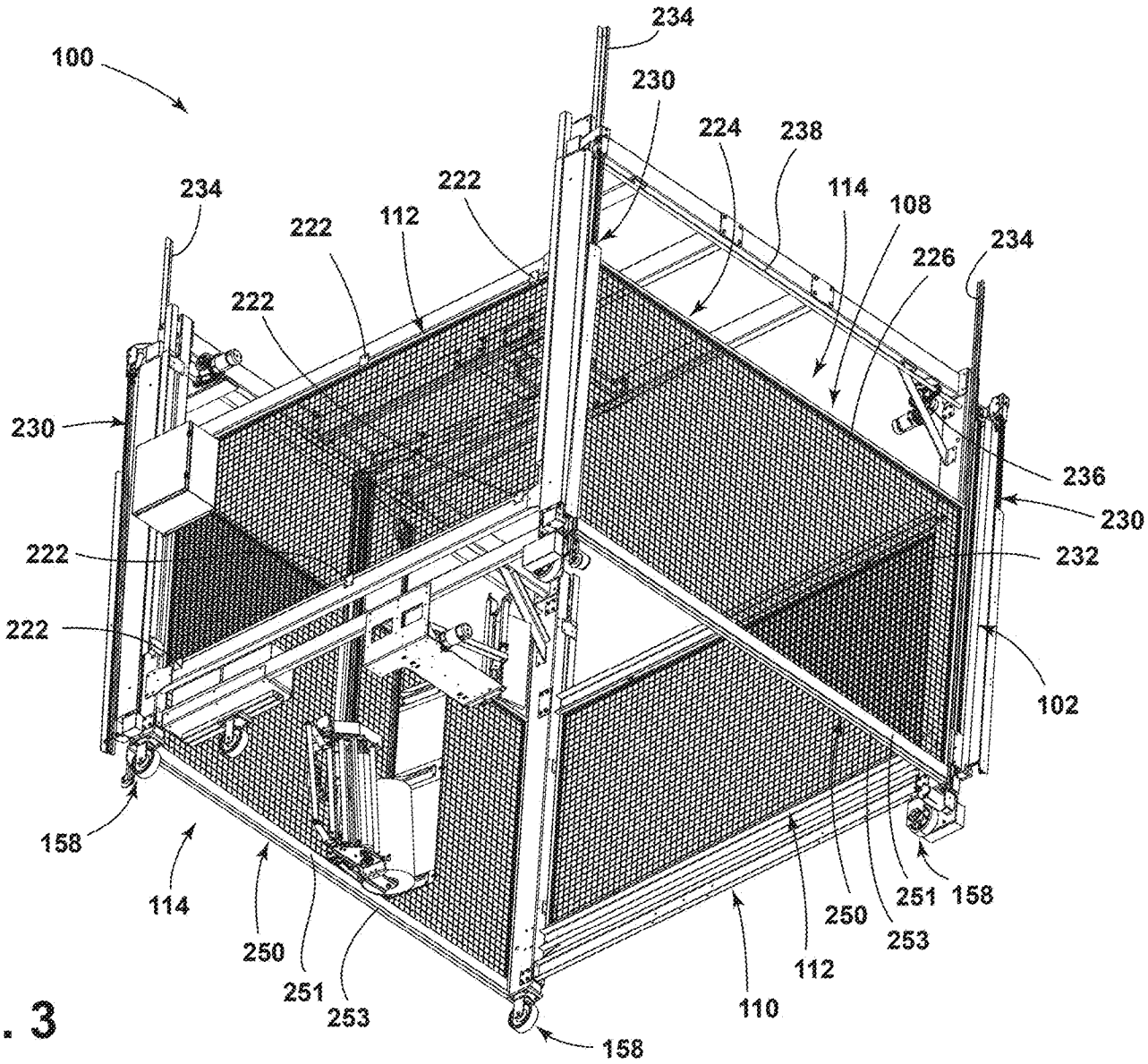
FIG. 3 is a bottom front perspective view of the portable wrapping machine of the present invention.

The illustrated fence system 108 prevents anyone from coming into the interior space 110 of the portable wrapping machine 100 during the wrapping process. The fixed side fences 112 of the fence system 108 are clipped to the fence support side beams 150 of the frame 102 by fence clips 222 as shown in FIG. 3. Any number of fence clips 222 or any other manner of connecting the fixed side fences 112 to the frame 102 can be used. In the illustrated system, the fixed side fences 112 of the fence system 108 remain stationary relative to the frame 102 at all times.

In the illustrated example, the movable gates 114 of the fence system 108 move to allow the portable wrapping machine 100 to move over empty pallets 16', partially full pallets 16" or full pallets 16*a*. The movable gates 114 have a lowered position as illustrated in FIGS. 2, 3, 13 and 14 and a raised position as shown in FIGS. 15 and 16. Each of the movable gates 114 includes an outer frame 224 comprising a top bar 226, a pair of side bars 228 and a bottom safety bar 250. A cage 232 is housed within the outer frame 224. The cage 232 can be a solid piece or can be a plurality of bars as shown (either forming squares or diamonds or any other configuration). The outer frame 224 moves on a pair of the gate tracks 128 of the uprights 116 of the frame 102. The gate tracks 128 have a plate 231 connected to the track face 134 of the main support beam 118 of the uprights 116 and a pair of facing channels 234 housing the side bars 228 of the outer frame 224 of the movable gate 114 to allow the outer frame 224 to slide vertically therein.

The illustrated movable gates 114 are raised and lowered by a lifting assembly 236. The lifting assembly 236 includes a lift rod 238 that extends through the main support beams 118 of the uprights 116 holding the movable gates 114. The lift rod 238 has a bearing in the main support beams 118 to allow the lift rod 238 to be easily rotated by a lift motor 240 connected to the upper cross beam 142. As shown in FIG. 4, the lift motor 240 has an output at a larger gear 242 that has an endless link 243 connected to a smaller gear 244 of the lift rod 238. The output of the lift motor 240 causes rotation of the lift rod 238. Ends of the lift rod 238 extend from the outer face 132 of the main support beams 118 of the uprights 116 and gears are connected thereto and located within the upper axel cover 124 of the uprights 116. An endless link 246 (e.g., a chain) wraps around the gear within the upper axel cover 124 to rotate with the gear and the lift rod 238. A lower end of the endless link 246 wraps about a lower gear located within the lower axel cover 126 of the upright 116. The endless link 246 forms an oval about the gears within the upper axel cover 124 and the lower axel cover 126, although it is contemplated that the link could have only an upper end that wraps about the upper gear.

In the illustrated example, as the lift motor 240 rotates the lift rod 238, the endless link 246 at each upright 116 alternatively moves clockwise or counterclockwise, depending on the selected output direction of the lift motor 240. A lift connector plate 248 is connected to the endless link 246 and to the side bars 228 of the outer frame 224 of the movable gate 114. Therefore, the output of the lift motor 240 can selectively lower the movable gate 114 as shown in FIGS. 2, 3, 13 and 14 and raise the movable gate 114 as shown in FIGS. 15 and 16.

As the portable wrapping machine 100 moves between pallet position areas 20 in the wrapping lane 18, the movable gates 114 are lifted to allow the portable wrapping machines 100 to move over empty pallets 16', partially filled pallets 16" and full pallets 16*a*. Likewise, the wrapping arm assembly 104 is rotated to the side so as to not interfere with movement of the portable wrapping machine 100. Once the portable wrapping machine 100 is in position to wrap the full pallet 16*a*, the lift motor 240 lowers the movable gates 114 to prevent anyone from entering the interior space 110 of the portable wrapping machine 100.

While a particular manner of raising and lowering the movable gates 114 is described herein, it is contemplated that any method of raising and lowering the movable gates 114 could be used (e.g., a rack and pinion system and/or use of multiple motors for each movable gate 114). Moreover, it is contemplated that the movable gates 114 could have different structures. For example, the movable gates 114 could have an accordion type structure such that the top of the movable gates 114 does not move, but a bottom of the movable gates 114 lifts along with any wall/cage to allow the portable wrapping machine 100 to move over items. Furthermore, it is contemplated that the movable gates 114 could open laterally either by moving from one upright 116 towards another upright 116 (e.g., with an accordion type structure) or opening in the middle and having two structures move from a center towards opposite uprights 116.

The illustrated movable gates 114 includes the bottom safety bar 250 (see FIGS. 2, 3 and 13-16) to stop movement of the movable gates 114 if the bottom safety bar 250 should encounter or sense an object (e.g., a person or a box) in the downward path thereof. The bottom safety bar 250 is configured to stop downward movement of the movable gates 114 when the bottom safety bar 250 identifies an object in the downward path of the moveable gates 114. The bottom safety bar 250 can identify an object in any manner (e.g., a mechanical abutment, an optical sensor, or any other type of sensor) (similar to the doors of an elevator). The illustrated example of the bottom safety bar 250 comprises a rail 251 having an actuator plate 253 extending downwardly therefrom. The actuator plate 253 is biased downward and is configured to be received upward within the rail 251 to activate an actuator or sensor to inform the control system of the portable wrapping machine 100 to discontinue downward movement of the movable gate 114 (along with possibly also raising the movable gate 114).

In the illustrated example, the frame 102 of the portable wrapping machine 100 includes a plurality of movement safety elements 230 to prevent movement of the portable wrapping machine 100 along the wrapping machine track 26 if the movement safety elements 230 should encounter or sense an object (e.g., a person or a box) in the path of the portable wrapping machine 100 along the wrapping machine track 26. The plurality of movement safety elements 230 are configured to stop movement of the portable wrapping machine 100 when the movement safety elements 230 identifies an object in the path thereof. The movement safety elements 230 can identify an object in any manner (e.g., a mechanical abutment, an optical sensor, or any other type of sensor) (similar to the doors of an elevator).

Figure 17:
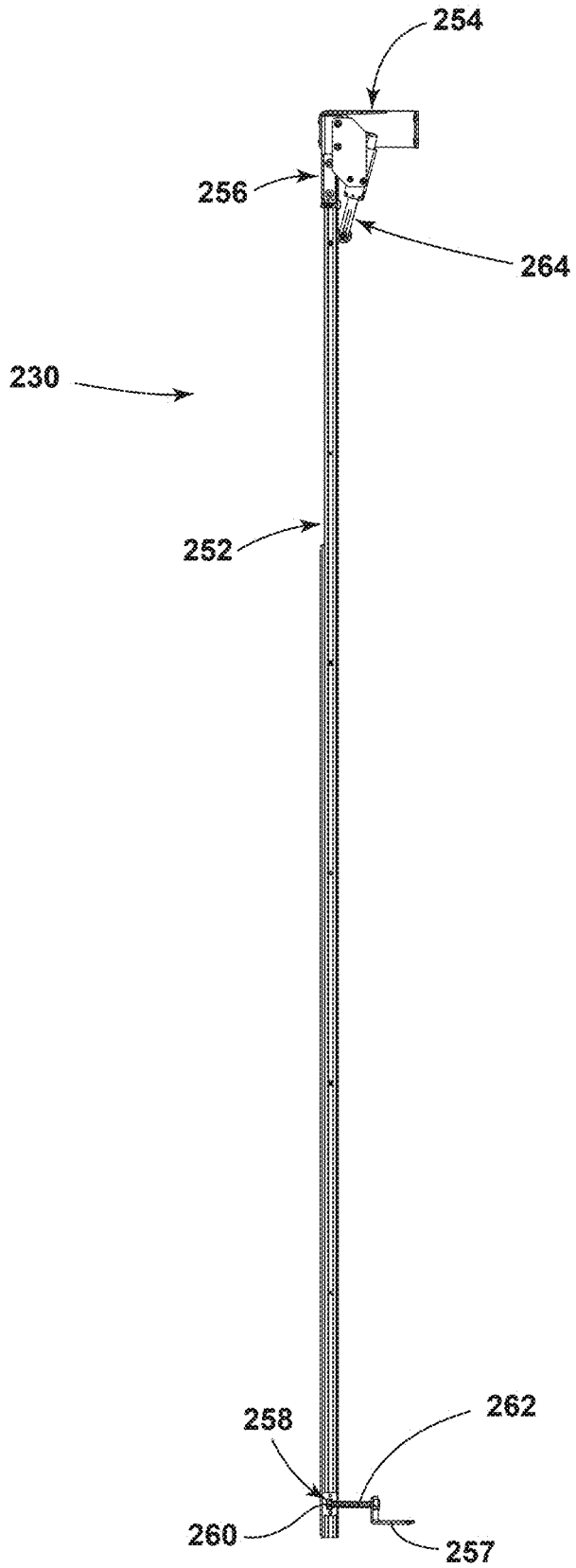
FIG. 17 is a side view of a frame movement safety bar of the portable wrapping machine of the present invention with paddles removed.
Figure 18:
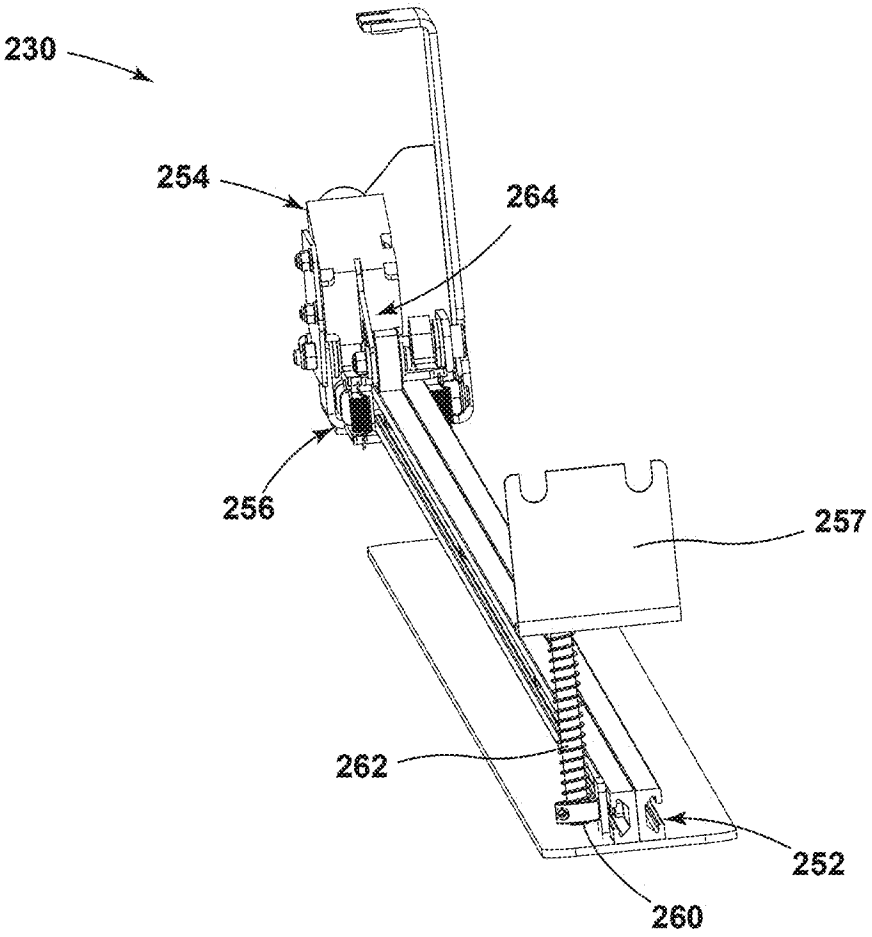
FIG. 18 is a perspective end view of the frame movement safety bar of the portable wrapping machine of the present invention.
Figure 19:
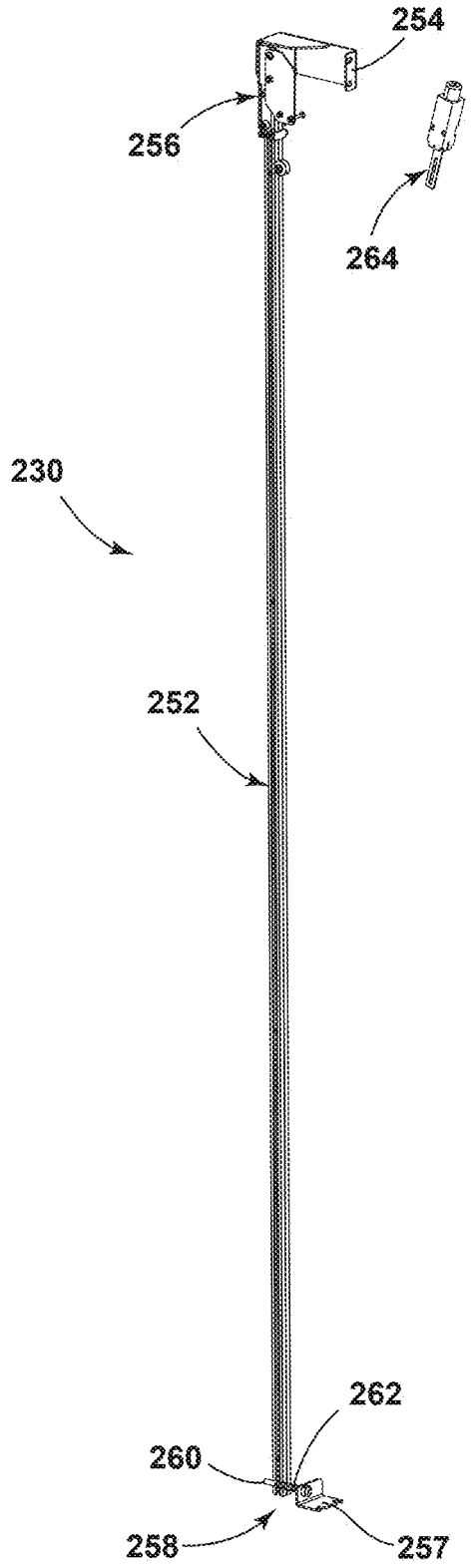
FIG. 19 is a side perspective exploded view of the frame movement safety bar of the portable wrapping machine of the present invention with a paddle removed.
Figure 20:
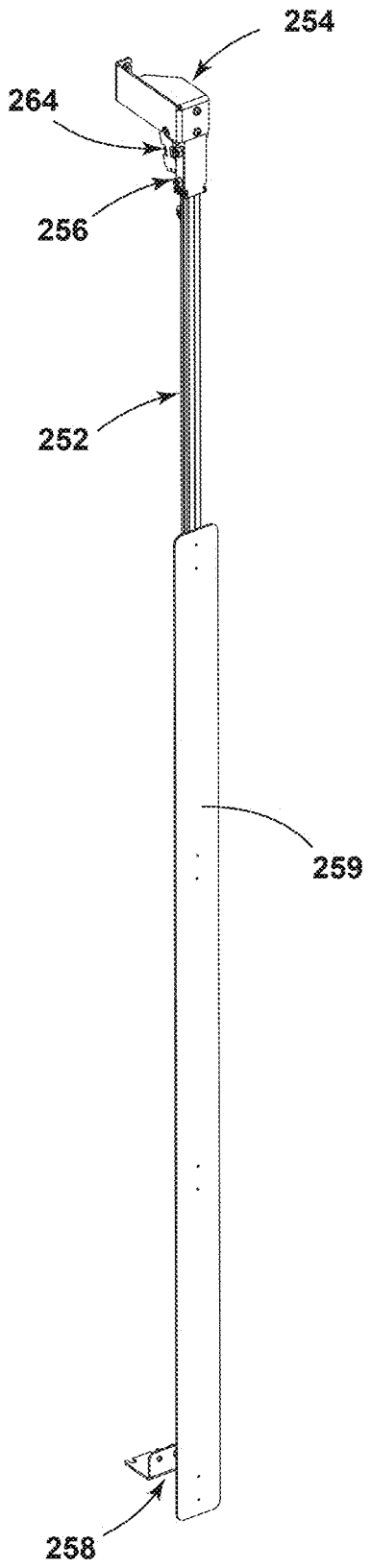
FIG. 20 is a front perspective view of the frame movement safety bar of the portable wrapping machine of the present invention.

The illustrated example of the plurality of movement safety elements 230 comprising a frame movement safety bar is shown in FIGS. 2-20. In the illustrated example, one of the frame movement safety bars 230 is located at each corner of the frame 102 and is connected to one of the uprights 116 of the frame 102. As shown in FIGS. 17-19, the frame movement safety bar 230 comprises an actuator rod 252 rotatably connected at a first end 256 thereof to an upper pivot plate 254. A second end 258 of the actuator rod 252 has a pin 260 extending laterally therefrom. An end of the actuator rod 252 opposite the pivot plate 254 slides on the pin 260. A spring 262 biases the actuator rod 252 outward. If the actuator rod 252 strikes or hits an object during movement of the frame 102, the actuator rod 252 will rotate upward about the pivot plate 254 against the bias of the spring 262. Such movement will actuate a sensor 264, which automatically stops downward movement of the frame 102. As illustrated in FIGS. 2-16, the upper pivot plate 254 is connected to the upper axel cover 124 of the upright 116 and the pin 260 is connected via an L-shaped flange 257 to the lower axel cover 126 of the upright 116. Each of the actuator rods 252 has an axis of rotation perpendicular to the direction of travel of the portable wrapping machine 100. It is contemplated that each actuator rod 252 could include a bumper plate 259 as shown in FIGS. 2-16 and 20 to increase the abutment area of the frame movement safety bar.

When any of the plurality of movement safety elements 230 or the bottom safety bars 250 are actuated, the portable wrapping machine 100 can stop any movement until the object causing the actuation is removed (either immediately or after a certain time period) or a manual reset button or switch is actuated.

It is contemplated that the portable wrapping machine 100 could be powered by batteries or by an inductive power system running in the wrapping lane 18. As shown in FIG. 4, the portable wrapping machine 100 could include batteries 600 on a support plate 602 connected to the lower side beam 140 of the frame 102. The support plate 602 can include a wheel 604 for supporting the support plate 602 and the batteries 600. As outlined above, the wrapping lane 18 could include at least one charger 34 for charging the batteries 600. The portable wrapping machine 100 can also include a control box 700 having a control system therein. The control box 700 could also include a touchscreen panel or other system for inputting information into the control system of the portable wrapping machine 100 or for obtaining system information of the portable wrapping machine 100.

The above description is considered that of the one embodiment only. Modification of the invention will occur to those skilled in the art and to those who make or use the invention. Therefore, it is understood that the embodiment shown in the drawings and described above is merely for illustrative purposes and not intended to limit the scope of the invention.

What is claimed is:

1. A pallet wrapping facility comprising:

a wrapping lane having a plurality of pallet position areas, each of the pallet position areas being configured to have a pallet positioned therein;

a portable wrapping machine that moves along the wrapping lane and being configured to stop at each of the pallet position areas to wrap a pallet full of goods in a particular one of the pallet position areas; and a track along the wrapping lane, the portable wrapping machine being configured to move along the track to the pallet position areas;

the portable wrapping machine including a frame for moving along the track to the particular one of the pallet position areas with the pallet full of goods therein;

the portable wrapping machine including a wrapping arm assembly for encircling the pallet full of goods to wrap the pallet full of goods with wrap film during a wrapping process;

the portable wrapping machine including a fence system for surrounding an interior space of the portable wrapping machine from before initiation of the wrapping process until the wrapping process is complete, the fence system including a pair of fixed side fences and a pair of movable gates;

each of the movable gates being configured to be moved to a movement position during movement of the portable wrapping machine along the track to and from the different ones of the pallet position areas to allow the portable wrapping machine to move to the different ones of the pallet position areas; and each of the movable gates also being configured, once the portable wrapping machine is in the particular one of the pallet position areas, to be moved from the movement position to a deployed position to thereby surround the interior space of the portable wrapping machine with the fence system while the wrapping arm assembly encircles the pallet full of goods to wrap the pallet full of goods in the wrap film.

2. The pallet wrapping facility of claim 1, wherein:

the portable wrapping machine includes a grip and cut assembly for gripping the wrap film during initiation of the wrapping process and for cutting the wrap film when the wrapping process is complete.

3. The pallet wrapping facility of claim 1, wherein:

the movable gates are raised to allow the portable wrapping machine to move to the different ones of the pallet position areas and lowered to surround the interior space of the portable wrapping machine with the fence system while the wrapping arm assembly encircles the pallet full of goods to wrap the pallet full of goods in the wrap film.

4. The pallet wrapping facility of claim 1, wherein:

each of the movable gates includes an actuation bar to stop movement of the movable gates from the movement position to the deployed position when the actuation bar encounters an object.

5. The pallet wrapping facility of claim 1, wherein:

each of the movable gates includes a fixed outer frame having a fence within a periphery of the fixed outer frame.

6. The pallet wrapping facility of claim 1, wherein:

the wrapping arm assembly includes a vertical portion and a carriage moving vertically along the vertical portion to wrap the pallet full of goods.

7. The pallet wrapping facility of claim 1, wherein:

the portable wrapping machine includes a plurality of movement wheels for moving the frame on the wrapping lane and a plurality of auxiliary wheels for traveling in the track.

8. The pallet wrapping facility of claim 1, wherein:

the wrapping arm assembly includes a carriage vertically movable on the wrapping arm assembly, the carriage having a roll of wrap film;

at least one motor for moving the wrapping arm assembly in a substantially circular direction and for moving the carriage vertically on the wrapping arm assembly;

the wrapping arm assembly being connected to the frame such that the wrapping arm assembly can move in the substantially circular direction about the pallet full of goods to wrap the pallet full of goods with film.

9. The pallet wrapping facility of claim 8, wherein:

the portable wrapping machine includes a bumper assembly movable with the wrapping arm assembly, the bumper assembly including a bumper and an actuator, wherein engagement of the bumper with an external object will actuate the actuator to stop movement of the wrapping arm assembly about the pallet full of goods.

10. The pallet wrapping facility of claim 1, wherein:

the frame includes a plurality of movement safety elements each including a movement safety bar to stop movement of the frame along the track when the movement safety bar encounters an object in the wrapping lane.

11. A portable wrapping machine comprising:

a movable frame for moving the portable wrapping machine along a track of a facility, the movable frame defining an interior space within a periphery of the movable frame;

a wrapping arm assembly connected to the movable frame for encircling a full pallet located within the interior space to wrap the full pallet with wrap film during a wrapping process; and a fence system connected to the movable frame for surrounding the interior space from before initiation of the wrapping process until the wrapping process is complete, the fence system including a pair of fixed side fences and a pair of movable gates;

each of the movable gates being configured to be raised during movement of the portable wrapping machine; and each of the movable gates also being configured, once the portable wrapping machine is in a location to wrap the full pallet, to be lowered to thereby surround the interior space of the portable wrapping machine with the fence system while the wrapping arm assembly encircles the full pallet to wrap the full pallet in the wrap film.

12. The portable wrapping machine of claim 11, further including:

a grip and cut assembly for gripping the wrap film during initiation of a wrapping process and for cutting the wrap film when the wrapping process is complete.

13. The portable wrapping machine of claim 11, wherein:

each of the movable gates includes an actuation bar to stop movement of the movable gates from a raised position to a lowered position when the actuation bar encounters an object.

14. The portable wrapping machine of claim 11, wherein:

each of the movable gates includes a fixed outer frame having a fence within the periphery of the fixed outer frame.

15. The portable wrapping machine of claim 11, wherein:

the wrapping arm assembly includes a vertical portion and a carriage moving vertically along the vertical portion to wrap the full pallet.

16. The portable wrapping machine of claim 11, wherein:

the movable frame includes a plurality of movement wheels for moving the movable frame and a plurality of auxiliary wheels for traveling in the track.

17. The portable wrapping machine of claim 11, wherein:

the wrapping arm assembly includes a carriage vertically movable on the wrapping arm assembly, the carriage having a roll of wrap film;

at least one motor for moving the wrapping arm assembly in a substantially circular direction and for moving the carriage vertically on the wrapping arm assembly;

the wrapping arm assembly being connected to the frame such that the wrapping arm assembly can move in the substantially circular direction about the full pallet to wrap the full pallet with film.

18. The portable wrapping machine of claim 17, further including:

a bumper assembly movable with the wrapping arm assembly, the bumper assembly including a bumper and an actuator, wherein engagement of the bumper with an external object will actuate the actuator to stop movement of the wrapping arm assembly about the full pallet.

19. The portable wrapping machine of claim 11, wherein: the movable frame includes a plurality of movement safety elements each including a movement safety bar to stop movement of the movable frame along the track when the movement safety bar encounters an object.

* * * * *